US011850848B2

(12) United States Patent
Arakane et al.

(10) Patent No.: US 11,850,848 B2
(45) Date of Patent: Dec. 26, 2023

(54) LIQUID DISCHARGING APPARATUS, METHOD FOR CONTROLLING THE LIQUID DISCHARGING APPARATUS, AND COMPUTER-READABLE STORAGE MEDIUM

(71) Applicant: BROTHER KOGYO KABUSHIKI KAISHA, Nagoya (JP)

(72) Inventors: Satoru Arakane, Nagoya (JP); Masao Mimoto, Kitanagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 135 days.

(21) Appl. No.: 17/591,865

(22) Filed: Feb. 3, 2022

(65) Prior Publication Data

US 2022/0250381 A1 Aug. 11, 2022

(30) Foreign Application Priority Data

Feb. 8, 2021 (JP) ..... 2021-018047

(51) Int. Cl.
*B41J 2/045* (2006.01)
*B41J 19/14* (2006.01)

(52) U.S. Cl.
CPC ..... *B41J 2/04586* (2013.01); *B41J 19/142* (2013.01)

(58) Field of Classification Search
CPC ..... B41J 2/04586; B41J 19/142
See application file for complete search history.

(56) References Cited

U.S. PATENT DOCUMENTS 9,319,554 B2 * 4/2016 Etoh ..... H04N 1/0071
2017/0282538 A1 10/2017 Saito
2020/0039259 A1 2/2020 Furuhata et al.

FOREIGN PATENT DOCUMENTS

JP 2006-334810 A 12/2006
JP 2009-298061 A 12/2009
JP 2017-177547 A 10/2017
JP 2018-199255 A 12/2018
JP 2020-121470 A 8/2020

* cited by examiner

*Primary Examiner* — Thinh H Nguyen
(74) *Attorney, Agent, or Firm* — Merchant & Gould P.C.

(57) ABSTRACT

A liquid discharging apparatus, having a head with nozzles, a scanning assembly, a conveyer, and a controller, is provided. The controller is configured to conduct actions including a conveying action and a scanning action. The scanning action includes a forward scanning action and a backward scanning action, in each of which a deceleration distance is longer than an acceleration distance. The controller is configured to determine, prior to conducting the forward scanning action, whether a deceleration range corresponding to the deceleration distance in the forward scanning action coincides with a discharging range in the forward scanning action. In a case where the controller determines that the deceleration range coincides with the discharging range, the controller is configured to conduct the backward scanning action, without conducting the forward scanning action, based on partial image data being a part of the image data corresponding to the forward scanning action.

11 Claims, 16 Drawing Sheets

LIQUID DISCHARGING APPARATUS, METHOD FOR CONTROLLING THE LIQUID DISCHARGING APPARATUS, AND COMPUTER-READABLE STORAGE MEDIUM

CROSS REFERENCE TO RELATED APPLICATIONS

This application claims priority under 35 U.S.C. § 119 from Japanese Patent Application No. 2021-018047, filed on Feb. 8, 2021, the entire subject matter of which is incorporated herein by reference.

BACKGROUND

The present disclosure is related to a liquid discharging apparatus, in which a deceleration distance of a head to move in a scanning action is longer than an acceleration distance, a method for controlling the liquid discharging apparatus, and a computer-readable storage medium storing computer readable instructions for controlling the liquid discharging apparatus.

A liquid discharging apparatus having a head mounted on a carriage is known. A travel distance of the carriage, in which a velocity of the carriage increases from zero (0) to V1, may be shorter than a travel distance of the carriage, in which the velocity of the carriage decreases from V1 to zero. In other words, the deceleration distance of the known head may be longer than an acceleration distance.

SUMMARY

When an image is formed not only while the head moves at a constant velocity but also while the head accelerates or decelerates, quality of the image may vary depending on whether the part of the image is formed while the head accelerates or decelerates or the part of the image is formed while the head moves at the constant velocity. Therefore, an overall quality of the image may be lowered.

The present disclosure is advantageous in that a liquid discharging apparatus, in which a deceleration distance of a head moving in a scanning action is longer than an acceleration distance, and in which lowering of imaging quality causable by forming an image while the head accelerates or decelerates may be restrained, is provided, and, moreover, a method for controlling the liquid discharging apparatus and a computer readable storage medium storing computer readable instructions for controlling the liquid discharging apparatus are provided.

According to an aspect of the present disclosure, a liquid discharging apparatus, including a head, a scanning assembly, a conveyer, and a controller, is provided. The head has a plurality of nozzles. The scanning assembly is configured to move the head in a scanning direction and includes a forward scanning direction and a backward scanning direction opposite to the forward scanning direction. The conveyer is configured to convey a recording medium with respect to the head in a conveying direction, which intersects with the scanning direction. The controller is configured to, for recording an image on the recording medium, conduct actions to control the head to discharge liquid through the plurality of nozzles at the recording medium based on image data. The actions include a conveying action, in which the controller controls the conveyer to convey the recording medium by a predetermined amount in the conveying direction, and a scanning action, in which the controller controls the scanning assembly to move the head in the scanning direction and controls the head to discharge the liquid through the plurality of nozzles while the head is moved by the scanning assembly. The scanning action includes a forward scanning action, in which the controller controls the head to discharge the liquid through the plurality of nozzles while moving the head in the forward scanning direction, and a backward scanning action, in which the controller controls the head to discharge the liquid through the plurality of nozzles while moving the head in the backward scanning direction. In each of the forward scanning action and the backward scanning action, a deceleration distance for the head is longer than an acceleration distance. The controller is further configured to determine, prior to conducting the forward scanning action, whether at least a part of a deceleration range corresponding to the deceleration distance in the forward scanning action coincides with a discharging range, in which the liquid is to be discharged through the plurality of nozzles, in the forward scanning action, and in a case where the controller determines that at least a part of the deceleration range coincides with the discharging range in the forward scanning action, conduct the backward scanning action, without conducting the forward scanning action, based on partial image data being a part of the image data corresponding to the forward scanning action.

According to another aspect of the present disclosure, a method for controlling a liquid discharging apparatus is provided. the liquid discharging apparatus includes a head, a scanning assembly, and a conveyer. The head has a plurality of nozzles. The scanning assembly is configured to move the head in a scanning direction, which includes a forward scanning direction and a backward scanning direction opposite to the forward scanning direction, The conveyer is configured to covey a recording medium with respect to the head in a conveying direction, which intersects with the scanning direction. The method includes, for recording an image on the recording medium, conducting actions to control the head to discharge liquid through the plurality of nozzles at the recording medium based on image data. The actions include a conveying action, in which the conveyer is controlled to convey the recording medium by a predetermined amount in the conveying direction, and a scanning action, in which the scanning assembly is controlled to move the head in the scanning direction and the head is controlled to discharge the liquid through the plurality of nozzles while being moved by the scanning assembly. The scanning action includes a forward scanning action, in which the head is controlled to discharge the liquid through the plurality of nozzles while being moved in the forward scanning direction, and a backward scanning action, in which the head is controlled to discharge the liquid through the plurality of nozzles while being moved in the backward scanning direction. In each of the forward scanning action and the backward scanning action, a deceleration distance for the head is longer than an acceleration distance. The method further includes, determining, prior to conducting the forward scanning action, whether at least a part of a deceleration range corresponding to the deceleration distance in the forward scanning action coincides with a discharging range, in which the liquid is to be discharged through the plurality of nozzles, in the forward scanning action, and in a case where at least a part of the deceleration range is determined to coincide with the discharging range in the forward scanning action, conducting the backward scanning action, without conducting the forward scanning action, based on partial image data being a part of the image data corresponding to the forward scanning action.

According to another aspect of the present disclosure, a non-transitory computer readable storage medium storing computer readable instructions that are executable by a computer configured to control a liquid discharging apparatus including a head, a scanning assembly, and a conveyer, is provided. The head has a plurality of nozzles. The scanning assembly is configured to move the head in a scanning direction, which includes a forward scanning direction and a backward scanning direction opposite to the forward scanning direction. The conveyer is configured to covey a recording medium with respect to the head in a conveying direction, which intersects with the scanning direction. The computer readable instructions, when executed by the computer, cause the computer to, for recording an image on the recording medium, conduct actions to control the head to discharge liquid through the plurality of nozzles at the recording medium based on image data. The actions include a conveying action, in which the computer controls the conveyer to convey the recording medium by a predetermined amount in the conveying direction, and a scanning action, in which the computer controls the scanning assembly to move the head in the scanning direction and controls the head to discharge the liquid through the plurality of nozzles while the head is moved by the scanning assembly. The scanning action includes a forward scanning action, in which the computer controls the head to discharge the liquid through the plurality of nozzles while moving the head in the forward scanning direction, and a backward scanning action, in which the computer controls the head to discharge the liquid through the plurality of nozzles while moving the head in the backward scanning direction. In each of the forward scanning action and the backward scanning action, a deceleration distance for the head is longer than an acceleration distance. The computer readable instructions, when executed by the computer, further cause the computer to determine, prior to conducting the forward scanning action, whether at least a part of a deceleration range corresponding to the deceleration distance in the forward scanning action coincides with a discharging range, in which the liquid is to be discharged through the plurality of nozzles, in the forward scanning action, and in a case where the computer determines that at least a part of the deceleration range coincides with the discharging range in the forward scanning action, conduct the backward scanning action, without conducting the forward scanning action, based on partial image data being a part of the image data corresponding to the forward scanning action.

DETAILED DESCRIPTION

First Embodiment

In the following paragraphs, with reference to the accompanying drawings, embodiments of the present disclosure will be described. It is noted that a printer described below is merely one embodiment of the present disclosure, and various connections may be set forth between elements in the following description. These connections in general and, unless specified otherwise, may be direct or indirect and that this specification is not intended to be limiting in this respect.

First, with reference to FIGS. 1-4, an overall configuration of a printer 100 and detailed configuration of the printer 100 according to a first embodiment of the present disclosure will be described.

Figure 1:
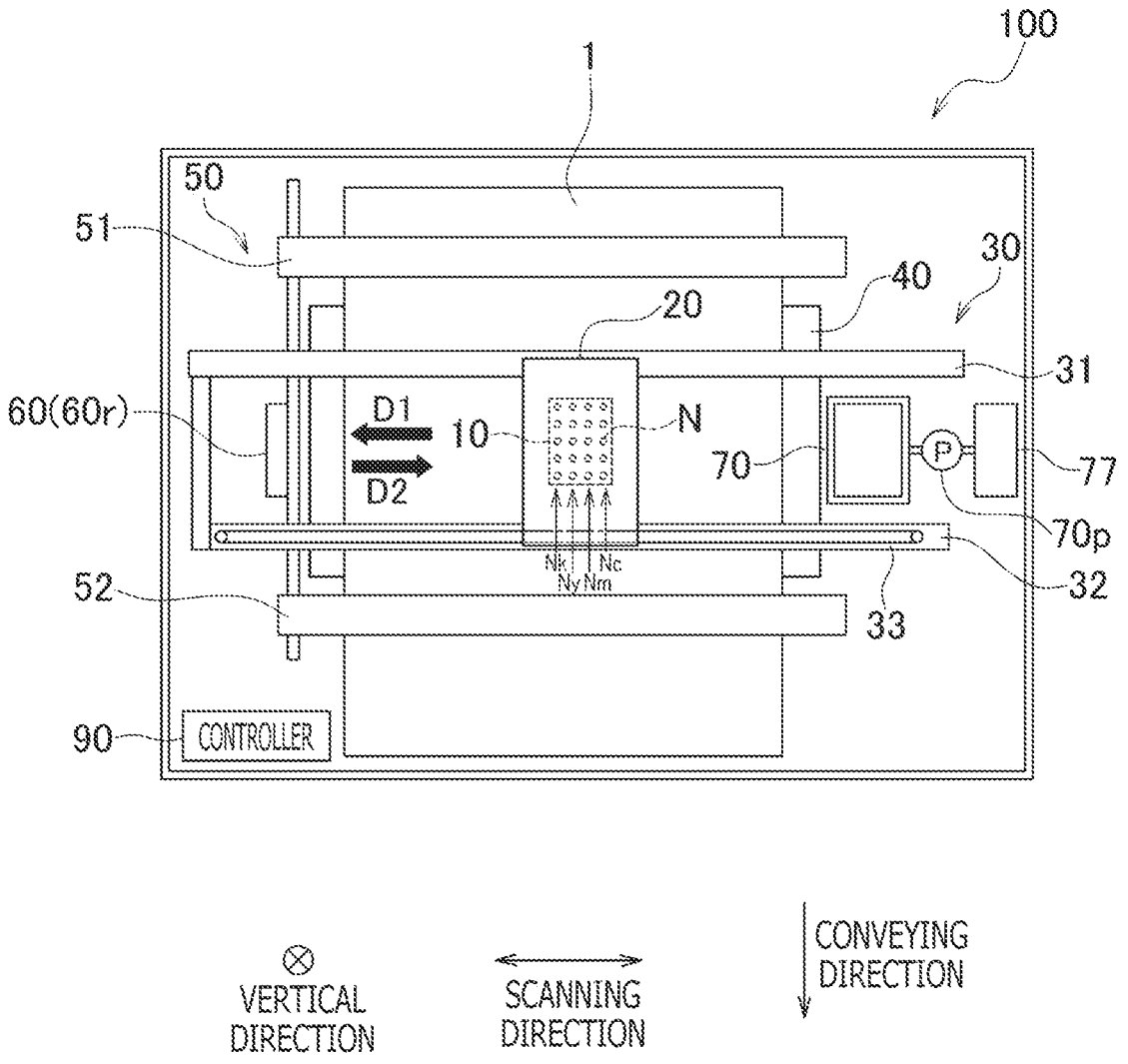
FIG. 1 is a plan view to illustrate an overall configuration of a printer according to a first embodiment of the present disclosure.

As shown in FIG. 1, the printer 100 has a head 10, a carriage 20, a scanning assembly 30, a platen 40, a conveyer 50, a flushing receiver member 60, a cap 70, and a controller 90. The head 10 has a lower surface, on which a plurality of nozzles N are formed. The carriage 20 retains the head 10. The scanning assembly 30 may move the carriage 20 and the head 10 in a scanning direction, which intersects orthogonally with a vertical direction. The platen 40 may support a sheet 1 (recording medium) from a lower side. The conveyer 50 may convey the sheet 1 in a conveying direction, which intersects orthogonally with the scanning direction and the vertical direction. The flushing receiver member 60 is located on one side of the platen 40 in the scanning direction, and the cap 70 is located on the other side of the platen 40 in the scanning direction.

The nozzles N form four (4) nozzle arrays Nc, Nm, Ny, Nk, which align side by side in the scanning direction. Each of the nozzle arrays Nc, Nm, Ny, Nk consists of a plurality of nozzles N, which align along the conveying direction. The nozzles N forming the nozzle array Nc may discharge cyan ink, the nozzles N forming the nozzle array Nm may discharge magenta ink, the nozzles N forming the nozzle array Ny may discharge yellow ink, and the nozzles N forming the nozzle array Nk may discharge black ink.

The scanning assembly 30 includes a pair of guides 31, 32, which support the carriage 20 and a belt 33 connected to the carriage 20. The guides 31, 32 and the belt 33 longitudinally extend in the scanning direction. When a carriage motor 30*m* (see FIG. 3) is driven under control of the controller 90, the belt 33 may run, and the carriage 20 and the head 10 may move along the guides 31, 32 in the scanning direction.

The scanning direction includes a forward scanning direction D1, which is leftward in FIG. 1, and a backward scanning direction D2, which is an opposite direction to the forward scanning direction D1, i.e., rightward in FIG. 1. The scanning assembly 30 may move the carriage 20 and the head 10 bidirectionally in the forward scanning direction D1 and the backward scanning direction D2.

The platen 40 is located at a lower position with respect to the head 10. On an upper surface of the platen 40, the sheet 1 may be placed to be supported.

The conveyer 50 has two (2) roller pairs 51, 52. Between the roller pair 51 and the roller pair 52 in the conveying direction, the head 10 and the platen 40 are arranged. When, under the control of the controller 90, a conveyer motor 50*m* (see FIG. 3) is driven, the roller pairs 51, 52 may nip the sheet 1 between the respective rollers and rotate to convey the sheet 1 in the conveying direction. Thus, the conveyer 50 may convey the sheet 1 relatively to the head 10.

The flushing receiver member 60 is arranged between the guides 31, 32 in the conveying direction and has a flushing range 60*r* on a surface thereof. The flushing range 60*r* is located outside a conveyable range, within which the sheet 1 may be conveyed by the conveyer 50, and adjoins the conveyable range in the scanning direction. In a flushing process, which will be described below, the liquid may be discharged at the flushing range 60*r* to flush the nozzles N.

The cap 70 is a box-shaped member, which is open on an upper side thereof. The cap 70 may move in the vertical direction by driving a cap lift motor 70*m* (see FIG. 3). When the head 10 is located above the cap 70, the cap lift motor 70*m* may be driven under the control of the controller 90, and the cap 70 may move upward. Thereby, the cap 70 may contact the lower face of the head 10 at an upper rim thereof, and a sealed space is formed between the cap 70 and the head 10. When the cap 70 contacts the lower face of the head 10, the nozzles N formed in the head 10 are entirely covered with the cap 70. The state of the cap 70 covering the entire nozzles N may be herein called as a capping state. On the other hand, when the cap 70 is separated from the head 10, not covering the nozzles N, in other words, a state, in which the sealed space is not formed between the cap 70 and the head 10, may be herein called as an uncapping state.

The cap 70 is connected with a waste ink tank 77 through a tube (not shown) and a suction pump 70*p*. When the cap 70 is in the capping state, the suction pump 70*p* may be driven under the control of the controller 90, and the pressure in the sealed space between the cap 70 and the head 10 may be reduced, and the ink may be expelled from the nozzles N. The expelled ink may be received in the cap 70 and may flow to the waste ink tank 77.

Figure 2:
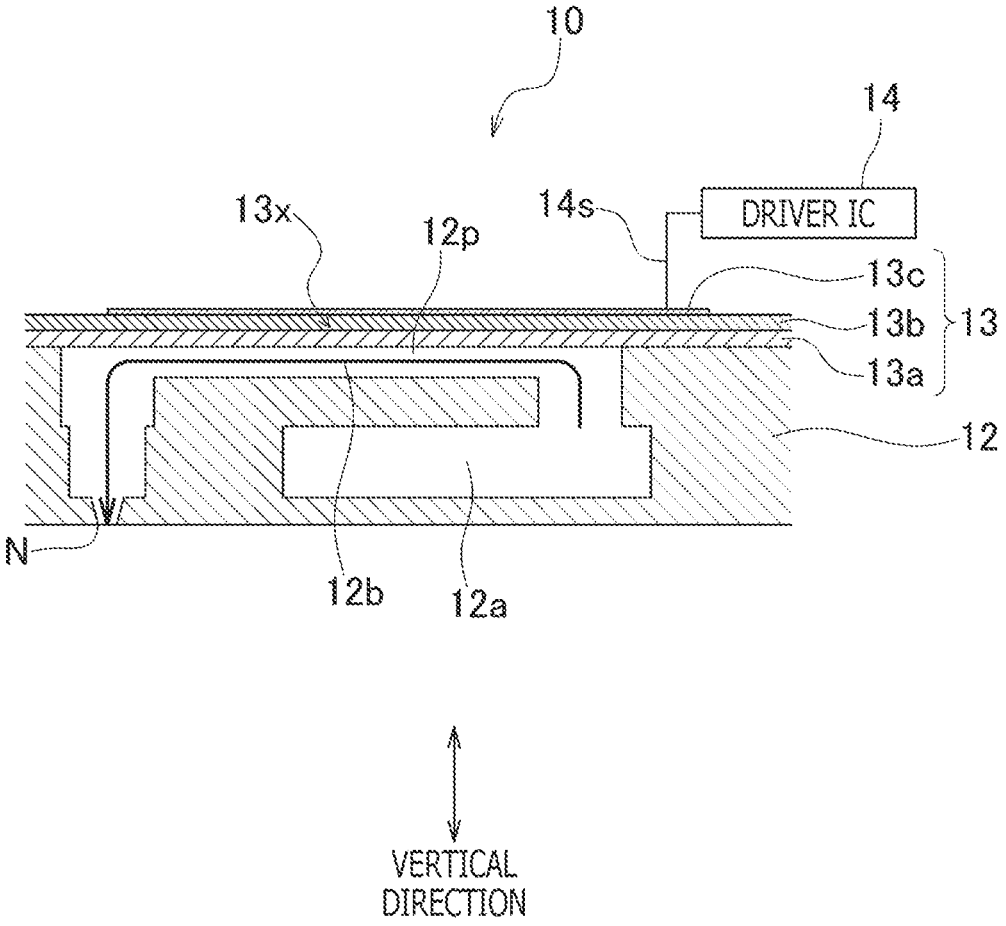
FIG. 2 is a cross-sectional view of a head in the printer according to the first embodiment of the present disclosure.

The head 10 includes a flow path unit 12 and an actuator unit 13, as shown in FIG. 2.

On a lower face of the flow path unit 12, the plurality of nozzles N (see FIG. 1) are formed. Inside the flow path unit 12, a common flow path 12*a*, which is connected to an ink tank (not shown), and individual flow paths 12*b*, each of which is connected to one of the nozzles N, are formed. The individual flow paths 12*b* are flow paths, each of which is continuous from an exit of the common flow path 12*a* through one of pressure chambers 12*p* to one of the nozzles N. The flow path unit 12 has the plurality of pressure chambers 12*p*, which are open to an upper side thereof.

The actuator unit 13 includes a metal-made vibration board 13*a*, a piezoelectric layer 13*b*, and a plurality of individual electrodes 13*c*. The vibration board 13*a* is arranged on the upper side of the flow path unit 12 to cover the plurality of pressure chambers 12*p*. The piezoelectric layer 13*b* is arranged on an upper side of the vibration board 13*a*. The plurality of individual electrodes 13*c* are arranged on an upper side of the piezoelectric layer 13*b*. Each of the individual electrodes faces toward one of the plurality of pressure chambers 12*p*.

The vibration board 13*a* and the plurality of individual electrodes 13*c* are connected electrically with a driver IC 14. The driver IC 14 maintains potential of the vibration board 13*a* at the ground potential and changes potentials of the individual electrodes 13*c* between the ground potential and a driving potential. In particular, the driver IC 14 may generate driving signals based on controlling signals, e.g., waveform signal FIRE and selection signal SIN, from the controller 90 and supply the driving signals to the individual electrodes 13*c* through signal lines 14*s*. Thereby, the potentials of the individual electrodes 13*c* may change between the driving potential and the ground potential. Accordingly, an actuator 13*x*, which is a part of the vibration board 13*a* and the piezoelectric layer 13*b*, interposed between the individual electrode 13*c* and the pressure chamber 12*p* may deform, and a volume of the pressure chamber 12*p* may change. Thereby, pressure may be applied to the ink in the pressure chamber 12*p*, and the ink may be discharged through the nozzle N. The actuator 13*x* is provided to each of the individual electrodes 13*c*, in other words, to each of the nozzles N, and may deform independently according to the potential supplied to the respective individual electrode 13*c*.

Figure 3:
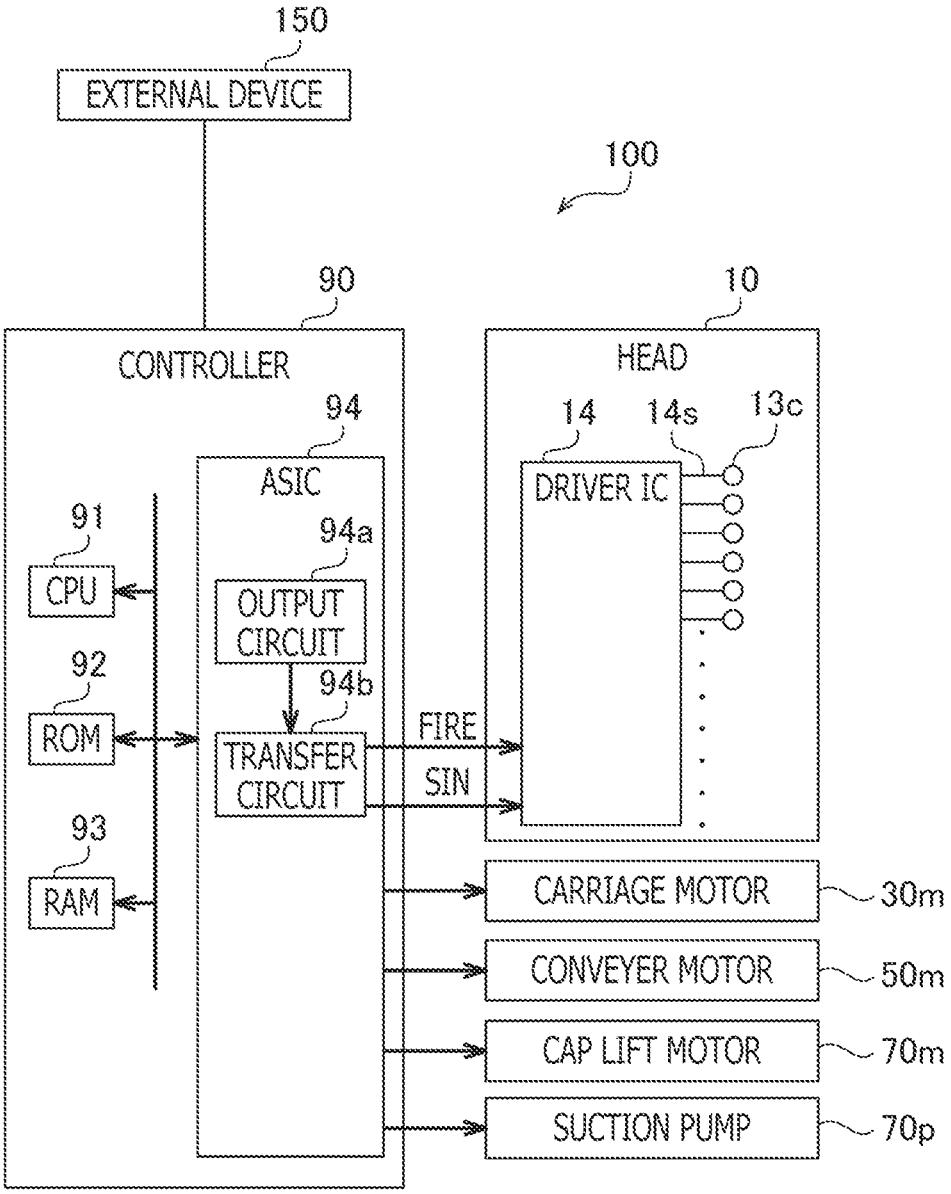
FIG. 3 is a block diagram to illustrate electrical components in the printer according to the first embodiment of the present disclosure.

The controller 90 includes, as shown in FIG. 3, a central processing unit (CPU) 91, a read only memory (ROM) 92, a random access memory (RAM) 93, and an application specific integrated circuit (ASIC) 94.

The ROM 92 stores programs and data to be used by the CPU 91 and/or the ASIC 94 to control operations in the printer 100. The RAM 93 may temporarily store data, such as image data, to be used by the CPU 91 and/or the ASIC 94 to execute the programs. The controller 90 is connected to communicate with an external device 150, such as a personal computer, and the CPU 91 and ASIC 94 may conduct processes, such as a recording process, based on the data input from the external device 150 and/or an input device, e.g., switches and buttons arranged on an exterior of a housing of the printer 100.

In the recording process, the ASIC 94 may control the driver IC 14, the carriage motor 30*m*, and the conveyer motor 50*m* according to commands from the CPU 91 and based on a record command, which includes image data, received from, for example, the external device 150. In particular, the ASIC 94 may alternately conduct a conveying action, in which the conveyer 50 conveys the sheet 1 in the conveying direction by a predetermined distance, and a scanning action, in which the scanning assembly 30 moves the head 10 in the scanning direction and the head 10 discharges the ink through the nozzles N to form dots on the sheet 1 while being moved. Thus, an image in dots may be recorded on the sheet 1.

The scanning action includes a forward scanning action, in which the head 10 is controlled to move in one way, e.g., in the forward scanning direction D1 (see FIG. 1), along the scanning direction and discharge the ink through the nozzles N while being moved, and a backward scanning action, in which the head 10 is controlled to move in the other way, e.g., in the backward scanning direction D2 (see FIG. 1), along the scanning direction and discharge the ink through the nozzles N while being moved. In the forward scanning action, the head 10 may start moving from a starting position, which overlaps the cap 70 in the vertical direction, and end moving at an ending position, which overlaps the flushing receiver member 60 in the vertical direction. In the backward scanning action, the head 10 may start moving from a starting position, which overlaps the flushing receiver member 60 in the vertical direction, and end moving at an ending position, which overlaps the cap 70 in the vertical direction.

Figure 4:
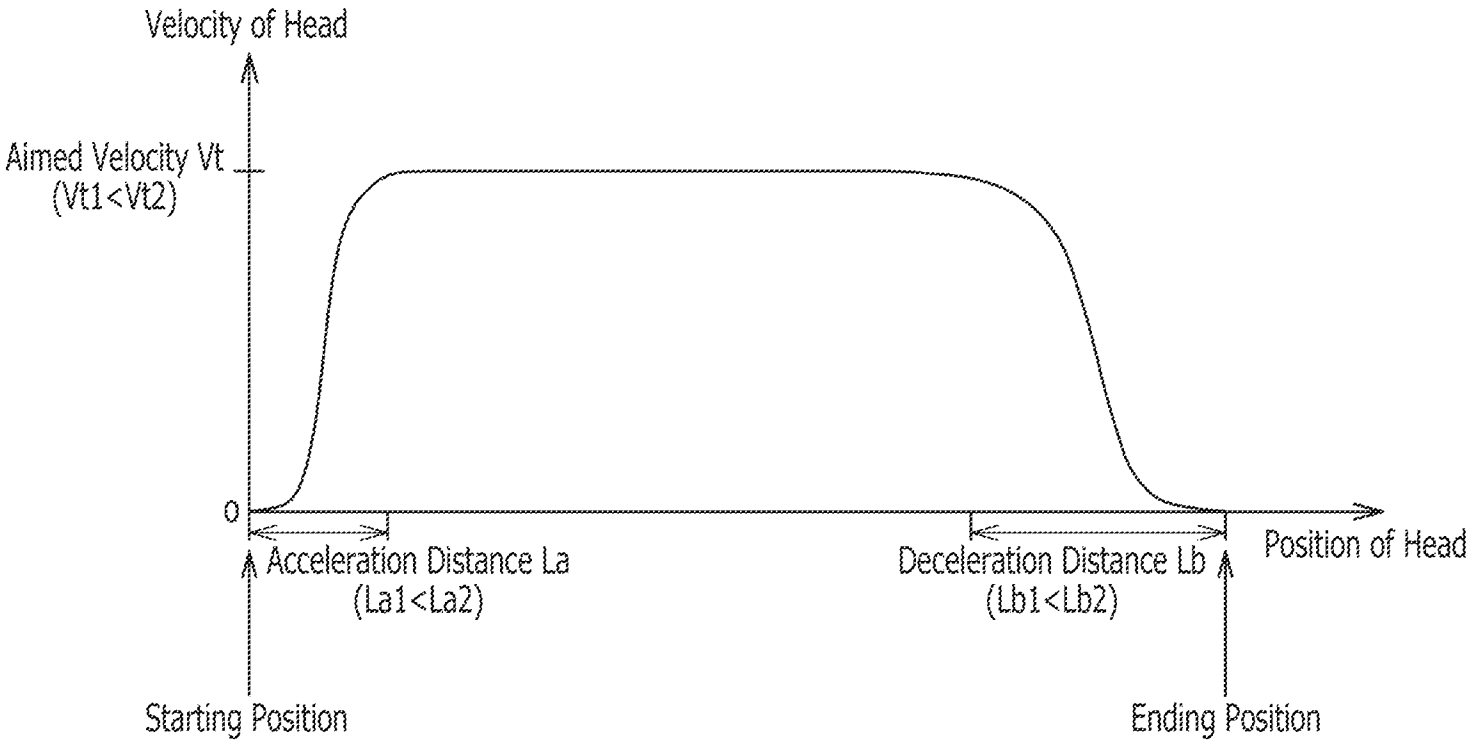
FIG. 4 is a graph to illustrate an acceleration distance and a deceleration distance of the head in the printer according to the first embodiment of the present disclosure.

As shown in FIG. 4, in each of the forward scanning action and the backward scanning action, a travel distance of the head 10, in which the velocity of the head 10 moving from a velocity zero (0) reaches an aimed velocity Vt (acceleration distance La), is shorter than a travel distance, in which the velocity of the head 10 decreases from the aimed velocity Vt to zero (deceleration distance Lb). In other words, in each of the forward scanning action and the backward scanning action, the deceleration distance Lb of the head 10 is longer than the acceleration distance La of the head 10. If the head 10 is decelerated too rapidly, a problem may occur that the head 10 may overrun a planned stop position or may stop short of the planned stop position. In this regard, by decelerating the head 10 moderately, in other words, by providing a longer decelerating distance Lb, the problem may be restrained.

The velocity of the head 10 at the starting position and the ending position is zero. The velocity of the head 10 increases from zero to the aimed velocity Vt while the head 10 travels the acceleration distance La from the starting position and is maintained at the aimed velocity Vt until the head 10 starts decelerating. Further, the velocity of the head 10 decreases from the aimed velocity Vt to zero while the head 10 travels the deceleration distance Lb to the ending position.

The CPU 91 conducts the forward scanning action and the backward scanning action in a recording process. Whether each scanning action to be conducted is the forward scanning action or the backward scanning action may be determined, for example, based on an evaluation table stored in the ROM 92. The evaluation table may be prepared for restraining differences in colors that may be caused depending on an order of overlaying the inks between the different scanning directions D1, D2, and in the evaluation table, sets of pixel values (RGB scale values between 0 and 255) and weight values are associated.

The ASIC 94 includes, as shown in FIG. 3, an output circuit 94*a* and a transfer circuit 94*b*.

The output circuit 94*a* may generate the waveform signal FIRE and the selection signal SIN and output the generated signals to the transfer circuit 94*b* at each recording cycle. The recording cycle is a time period required for the sheet 1 to move with respect to the head 10 by a unit distance corresponding to a resolution of the image to be formed on the sheet 1, which corresponds to one pixel.

The waveform signal FIRE is a serial signal, in which four units of waveform data are serially combined. Each unit of waveform data indicates a size of a droplet of the ink, which is one of "zero (no discharging)," "small," "medium," and "large" having different numbers of pulses, to be discharged from the nozzle N in the single recording cycle.

The selection signal SIN is a serial signal containing selection data for selecting one of the four units of waveform data. The selection signal SIN is generated for each of the actuators 13*x* and for each recording cycle based on the image data contained in the record command.

The transfer circuit 94*b* may transfer the waveform signal FIRE and the selection signal SIN received from the output circuit 94*a* to the driver IC 14. The transfer circuit 94*b* incorporates an LVDS (low voltage differential signaling) driver corresponding to the waveform signal FIRE and the selection signal SIN and may transfer the waveform signal FIRE and the selection signal SIN to the driver IC 14 as pulse-formed differential signals.

The ASIC 94 may, in the recording process, control the driver IC 14 to generate driving signals based on the waveform signal FIRE and the selection signal SIN for each pixel and supply the generated driving signals to the individual electrodes 13*c* through the signal lines 14*s*. Thereby, the ASIC 94 may cause the ink to be discharged from each of nozzles N in the size selected among the four droplet sizes, which are zero, small, medium, and large, at the sheet P.

Next, with reference to FIGS. 5-7, the program to be executed by the CPU 91 will be described.

When the program starts, the head 10 is located above the cap 70 (see FIG. 1), and the cap 70 is in the capping state. In this arrangement, the nozzles N formed in the head 10 are entirely covered with the cap 70.

Figure 5:
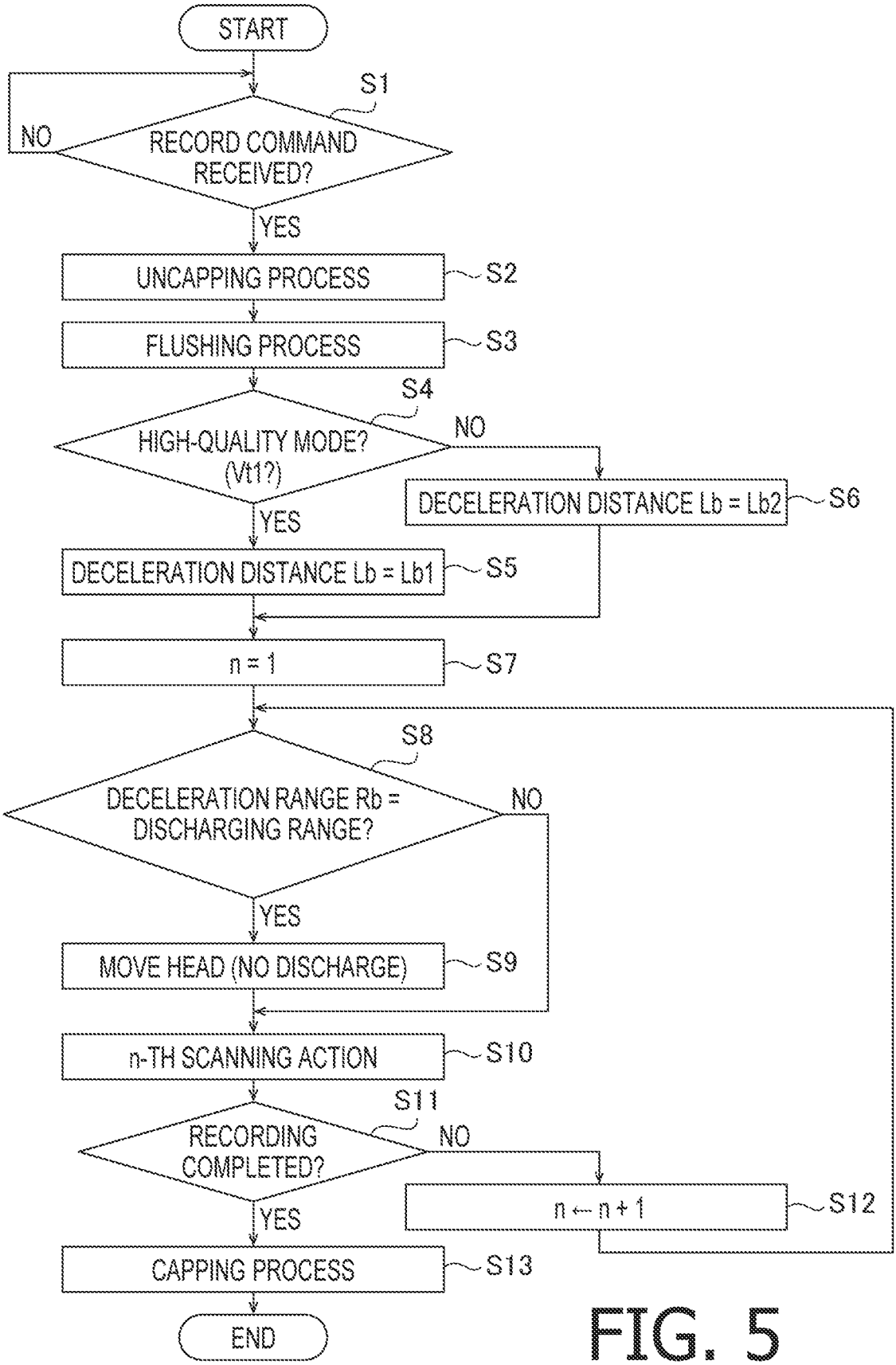
FIG. 5 is a flowchart to illustrate a flow of steps in a program to be executed by a CPU in the printer according to the first embodiment of the present disclosure.

First, in 51, as shown in FIG. 5, the CPU 91 determines whether the record command is received from, for example, the external device 150. If the record command is not received (S1: NO), the CPU 91 repeats 51.

If the record command is received (S1: YES), in S2, the CPU 91 drives the cap lift motor 70*m* to move the cap 70 downward, and the cap 70 is shifted from the capping state to the uncapping state (S2: uncapping process).

After S2, in S3, the CPU 91 controls the carriage motor 30*m* to drive the scanning assembly 30 to move the head 10 in the scanning direction toward the flushing receiver member 60 (see FIG. 1). While the head 10 is moving, the CPU 91 may drive the driver IC 14 based on flushing data, which is different from the image data, to deform the actuators 13*x* at the timing when each of the nozzle arrays Nc, Nm, Ny, Nk overlaps the flushing range 60*r* in the vertical direction to discharge the ink through the nozzles N that belong to the respective one of the nozzle arrays Nc, Nm, Ny, Nk. The discharged ink may be received in the flushing range 60*r* and flow to the waste ink tank 77.

After S3, in S4, the CPU 91 determines whether a recording mode indicated in the record command received in S1 is a high-quality mode. In the present embodiment, the recording mode includes the high-quality mode and a regular-quality mode. The aimed velocity Vt in the high-quality mode and the aimed velocity V1 in the regular-quality mode are different (see FIG. 4). The aimed velocity Vt in the regular-quality mode (a second velocity Vt2) is faster than the aimed velocity Vt in the high-quality mode (a first velocity Vt1).

If the recording mode is the high-quality mode (S4: YES), in S5, the CPU 91 determines a first deceleration distance Lb1 to be the deceleration distance. If the recording mode is not the high-quality mode (S4: NO), in other words, if the recording mode is the regular-quality mode, in S6, the CPU 91 determines a second deceleration distance Lb2 to be the deceleration distance Lb (Lb2>Lb1). The first and second deceleration distances Lb1, Lb2 are stored in the ROM 92. In S5 or S6, the CPU 91 may read the first or second deceleration distance Lb1, Lb2 in the ROM 92 to store in the RAM 93.

After S5 or S6, in S7, the CPU 91 assigns 1 to n (n=1). The sign n represents a number assigned to each one of the scanning actions contained in the record command received in S1, numbered in a chronological order.

Figure 6:
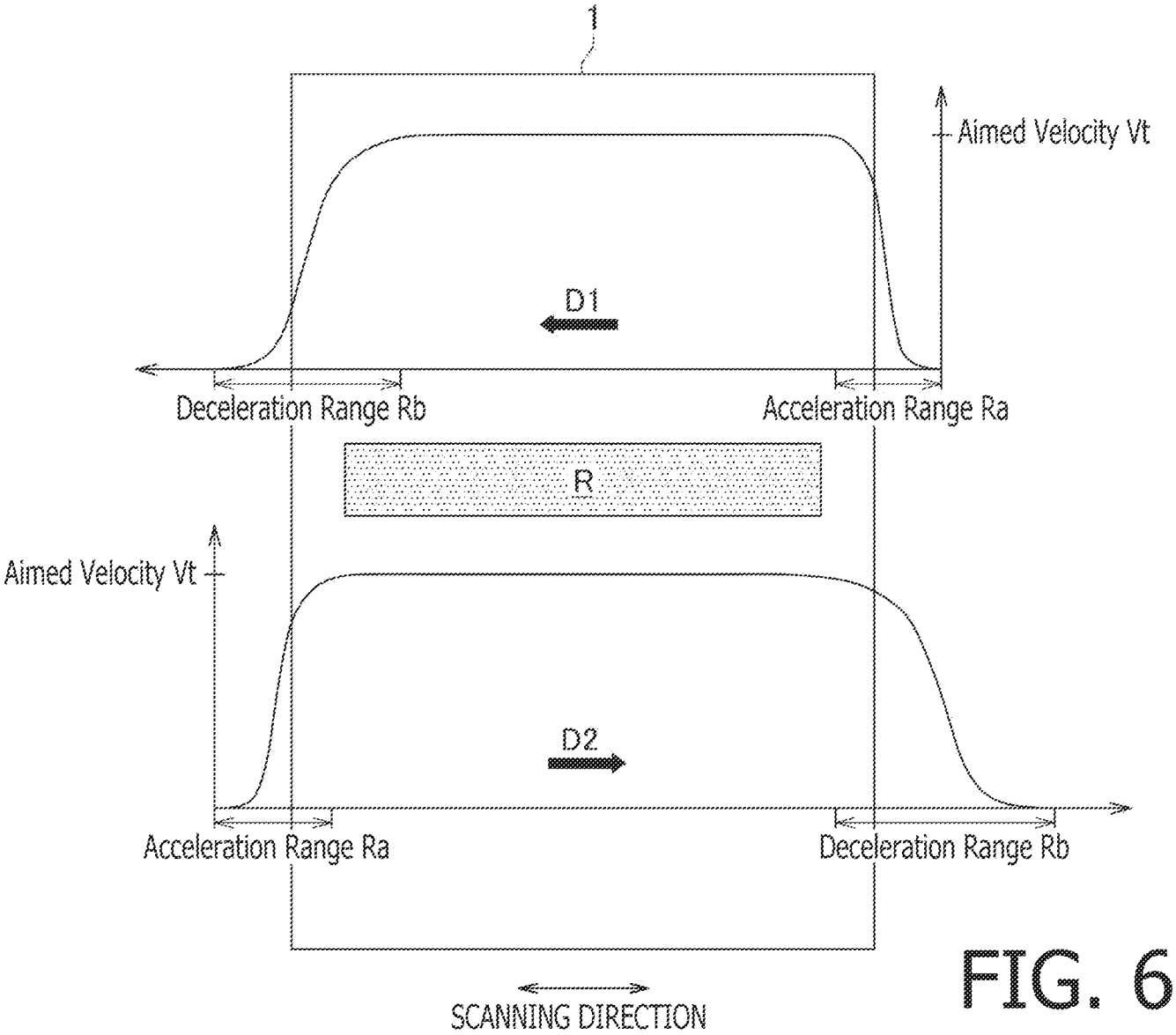
FIG. 6 is a schematic diagram to illustrate S8-S10 in the flowchart shown in FIG. 5 according to the embodiment of the present disclosure.

After S7, in S8, the CPU 91 determines whether at least a part of a deceleration range Rb coincides with a discharging range R (see FIG. 6). The discharging range R is a range, in which the inks may be discharged through the nozzles N in the n-th scanning action. The deceleration range Rb is a range, which corresponds to the deceleration distance Lb, i.e., the first deceleration distance Lb1 or the second deceleration distance Lb2 stored in the RAM 93 in either S5 or S6, in the n-th scanning action. The deceleration range Rb is a range, which overlaps the head 10 in the vertical direction when the head 10 travels the deceleration distance Lb, and in which the velocity of the head 10 decreases from the aimed velocity Vt to zero. Meanwhile, an acceleration range Ra is a range, which overlaps the head 10 in the vertical direction when the head 10 travels the acceleration distance La, and in which the velocity of the head 10 increases from zero to the aimed velocity Vt.

In S8, the CPU 91 may determine that at least a part of the deceleration range Rb coincides with the discharging range R (S8: YES) if a planned stop position of the head 10 exceeds a stop-limit position (see FIG. 7), in other words, if the planned stop position is located downstream in the scanning direction of the n-th scanning action with respect to the stop-limit position (see also FIG. 6). On the other hand, if the planned stop position of the head 10 does not exceed the stop-limit position, in other words, if the planned stop position is located either upstream with respect to the stop-limit position or at the same position as the stop-limit position in the scanning direction of the n-th scanning action, the CPU 91 may determine that the deceleration range Rb does not coincide with the discharging range R (S8: NO).

The planned stop position is a position separated from an end Rx of the discharging range R in the scanning direction of the n-th scanning action (in the forward scanning direction D1 or the backward scanning direction D2) by a distance combining the deceleration distance Lb, a distance $\alpha$, and a distance Ln in the forward scanning direction D1 or the backward scanning direction D2. The distance $\alpha$ is a value, which is set in consideration of accuracy for stopping the head 10. The distance Ln is a distance, which is between an end 10$x$ of the head 10 on a leading side in the scanning direction of the n-th scanning action (e.g., a leftward end in the forward scanning direction D1 or a rightward end in the backward scanning direction D2) and one of the nozzle arrays among the nozzle arrays Nc, Nm, Ny, Nk that are to discharge the inks in the n-th scanning action located at an end on a leading side in a direction reversed from the scanning direction in the n-th scanning action (e.g., a rightward end in the backward scanning direction D2 or a leftward end in the forward scanning direction D1).

Figure 9:
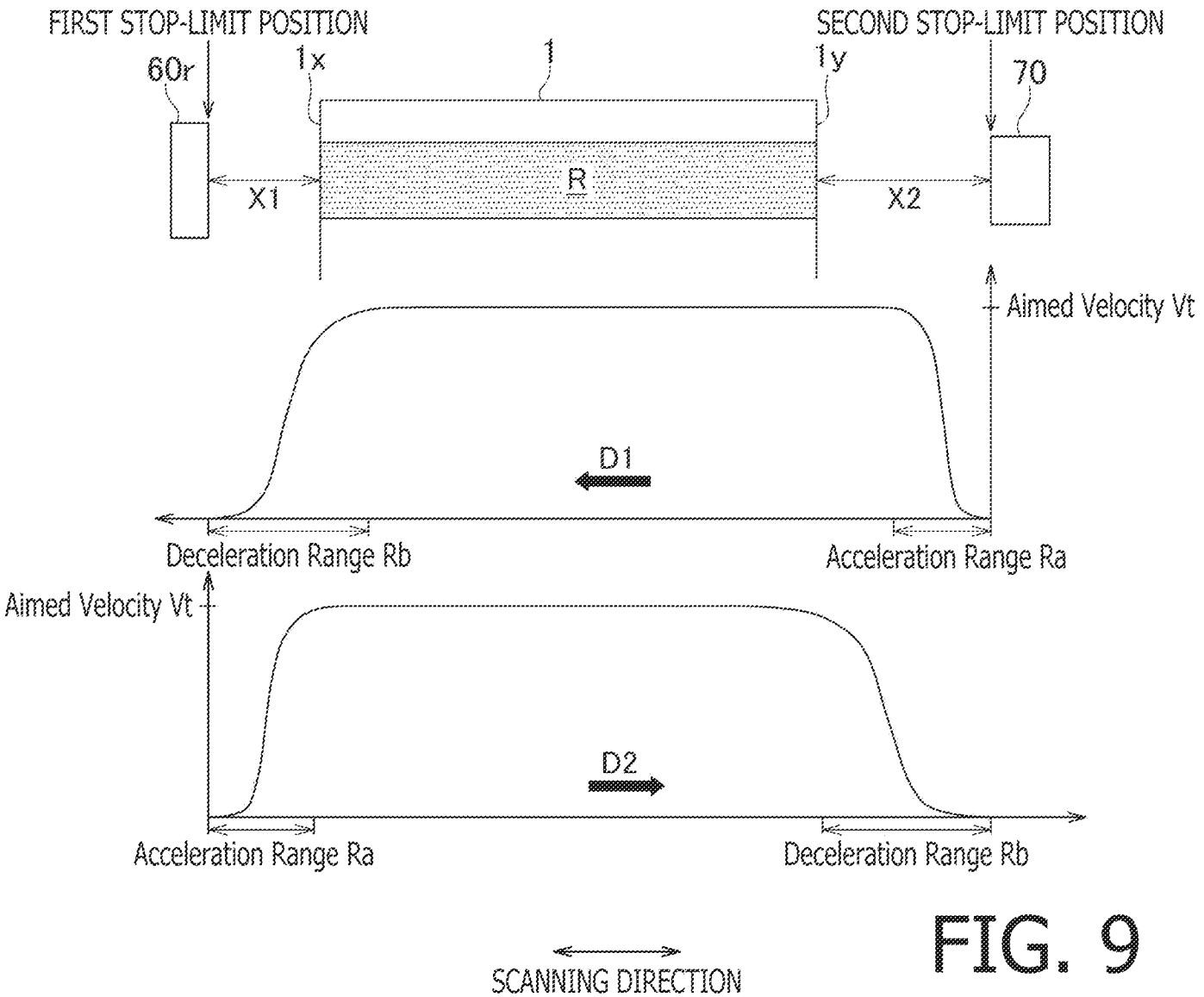
FIG. 9 is a schematic diagram to illustrate S20, S21 in the flowchart shown in FIG. 8A according to the second embodiment of the present disclosure.

The stop-limit position is a position of limit, at which the head 10 may be restrained from colliding with the housing of the printer 100 or other parts or members in the printer 100, such as the cap 70, the flushing receiver member 60, etc., and includes a first stop-limit position and a second stop-limit position (see FIG. 9). The first stop-limit position and the second stop-limit position are located on one side and the other side of the sheet 1 in the scanning direction, respectively. The first stop-limit position is a stop-limit position when the scanning action is the forward scanning action, and a distance X1 between the first stop-limit position and an end 1$x$ of the sheet 1 in the scanning direction is shorter than a distance between the first stop-limit position and the other end 1$y$ of the sheet 1 in the scanning direction. The second stop-limit position is a stop-limit position when the scanning action is the backward scanning action, and a distance X2 between the second stop-limit position and the other end 1$y$ of the sheet 1 in the scanning direction is shorter than a distance between the second stop-limit position and the one end 1$x$ of the sheet 1 in the scanning direction. For the determination in S8, when the n-th scanning action is the forward scanning action, the first stop-limit position is referred to, or when the n-th scanning action is the backward scanning action, the second stop-limit position is referred.

Figure 7:
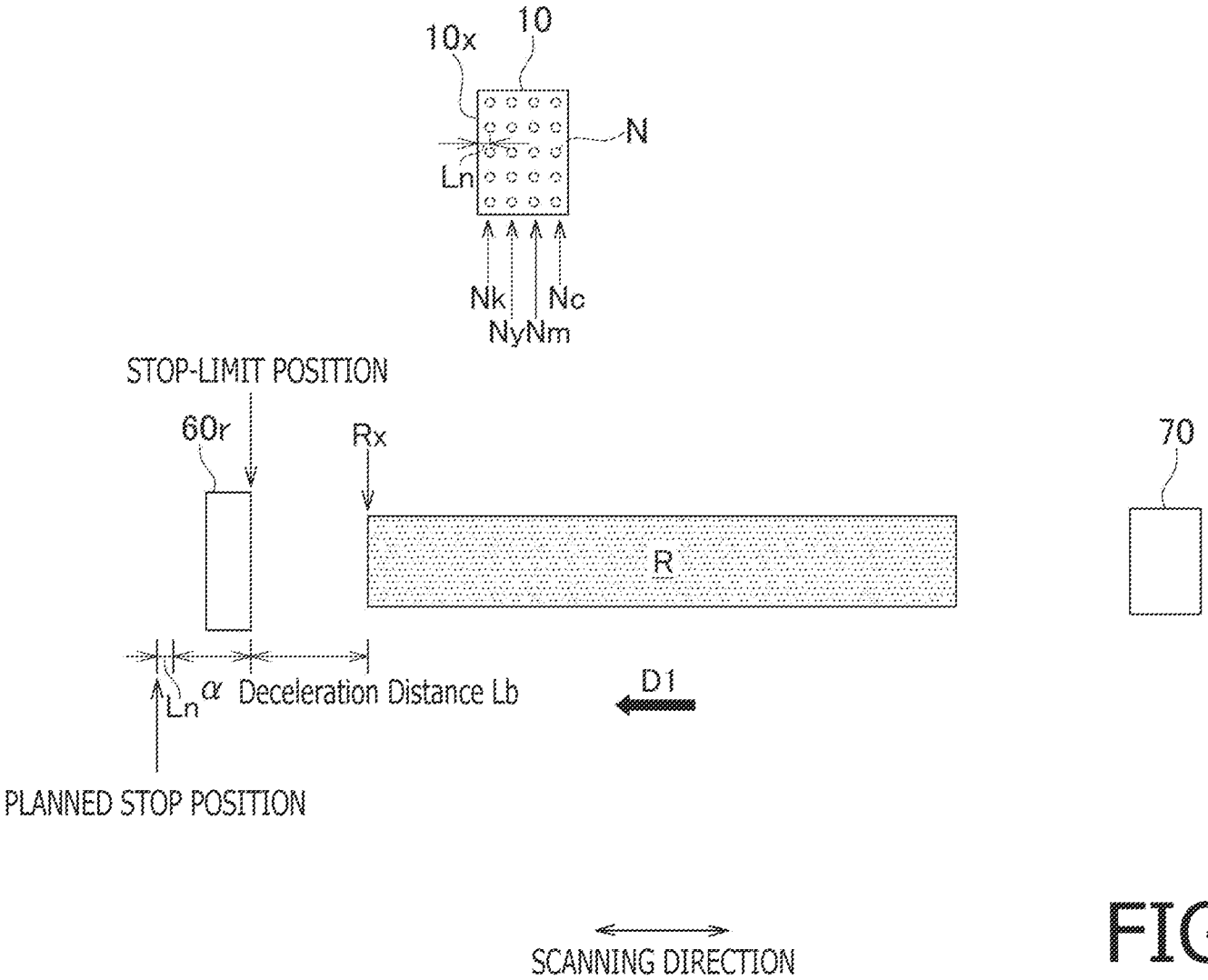
FIG. 7 is a schematic diagram to illustrate S8 in the flowchart shown in FIG. 5 according to the embodiment of the present disclosure.

FIG. 7 shows an example, in which the n-th scanning action is the forward scanning action, and in which the ink is discharged through the nozzle array Nk alone in the n-th scanning action. When, for another example, the inks are discharged through all of the nozzle arrays Nc, Nm, Ny, Nk in the n-th scanning action, the distance Ln is equal to a distance between the end 10$x$ of the head 10 and the nozzle array Nc in the scanning direction.

If at least a part of the deceleration range Rb coincides with the discharging range R (S8: YES), in S9, the CPU 91 controls the head 10 to move in the scanning direction as it has been planned initially, e.g., the forward scanning direction D1 in the example of FIG. 7, without discharging the ink through the nozzles N.

After S9, or if the deceleration range Rb does not coincide with the discharging range R (S8: NO), in S10, the CPU 91 conducts the n-th scanning action based on partial image data, which is a part of the image data contained in the record command corresponding to the n-th scanning action.

In S10 to be conducted after the negative determination in S8 that the deceleration range Rb does not coincide with the discharging range R (S8: NO), the CPU 91 controls the head 10 to move in the scanning direction (either the forward or backward scanning action) as it has been planned initially.

On the other hand, in S10 to be conducted after S9 following the positive determination in S8, the scanning action is conducted in a direction opposite to the scanning action as it was planned initially. In other words, if the forward scanning action was planned initially, the backward scanning action is conducted in S10, or if the backward scanning action was planned initially, the forward scanning action is conducted in S10.

For example, as shown in FIG. 6, when the forward scanning action is planned initially as the n-th scanning action, and if at least a part of the deceleration range Rb coincides with the discharging range R (S8: YES), in S9, the CPU 91 may not conduct the forward scanning action as the n-th scanning action, in other words, the CPU 91 may control the head 10 to move in the forward scanning direction D1 without causing the head 10 to discharge the inks through the nozzles N, and following S9, in S10, the CPU 91 may conduct the backward scanning action as the n-th scanning action. In the example of FIG. 6, if the backward scanning action is conducted as the n-th scanning action, no part of the acceleration range Ra or the deceleration range Rb may coincide with the discharging range R. In other words, the image may not be formed while the head 10 is accelerating or decelerating, but the image may be formed while the head 10 moves at the constant velocity.

On the other hand, when the forward scanning action is planned initially as the n-th scanning action, and if the deceleration range Rb does not coincide with the discharging range R (S8: NO), in S10, the CPU 91 may conduct the forward scanning action as the n-th scanning action.

In S10, the CPU 91 converts the image data, i.e., data of red, green, and blue (RGB) values corresponding to colors in the image to be recorded, into discharge data, i.e., data of CMYK values corresponding to the colors of the inks. The discharge data indicates a size of each droplet of the ink, which is one of "zero (no discharging)," "small," "medium," and "large," to be discharged from the nozzle N in a single recording cycle. In S10 that follows S9, the scanning action is conducted in the direction reversed from the direction having been planned initially; therefore, a sequence of the discharge data is reversed from the order in the initial discharge data.

After S10, in S11, the CPU 91 determines whether the recording process based on the record command received in S1 is completed. The CPU 91 may determine the recording process is completed (S11: YES) when the number n is equal to M (n=M). The sign M represents a total number of the scanning actions determined based on the image data in the record command.

If the recording process is not completed (S11: NO), in S11, the CPU 91 increments n by one (n=n+1). The CPU 91 returns to S8.

If the recording process is completed (S11: YES), the CPU 91 drives the scanning assembly 30 to move the head 10 in the scanning direction toward the cap 70 and stops the head 10 at the position above the cap 70. Thereafter, the CPU 91 drives the cap lift motor 70*m* to move the cap 70 upward and shift the cap 70 from the uncapping state to the capping state (S13: capping process).

After S13, the CPU 91 terminates the program.

As described above, according to the present embodiment, the deceleration distance Lb for the head 10 is longer than the acceleration distance La in each of the forward scanning action and the backward scanning action (see FIG. 4). If at least a part of the deceleration range Rb coincides with the discharging range R in the n-th scanning action (S8: YES), e.g., the forward scanning action in the example of FIG. 6, the CPU 91 may not conduct the n-th scanning action as initially planned, e.g., the forward scanning action in the example of FIG. 6, but may conduct the scanning action, e.g., the backward scanning action in the example of FIG. 6, in the direction reversed from the initially planned scanning action. Since the deceleration distance Lb is longer than the acceleration distance La in each scanning action, the CPU 91 may determine whether at least a part of the deceleration range Rb coincides with the discharging range R, and when the CPU 91 determines that at least a part of the deceleration range Rb coincides with the discharging range R, the scanning action in the reversed direction may be conducted so that the image may not be formed while the head 10 is accelerating or decelerating but may be formed while the head 10 moves at the constant velocity. Therefore, according to the embodiment described above, when the deceleration distance Lb is longer than the acceleration distance La in the scanning action, the imaging quality that may otherwise be lowered by forming the image while the head 10 accelerates or decelerates may be restrained from being lowered.

In particular, when the aimed velocity Vt is increased for faster recording, the acceleration distance La and the deceleration distance Lb tend to be longer, and the image may more likely be formed while the head 10 accelerates and decelerates. Therefore, the problem of lowering the imaging quality may become more noticeable. However, according to the embodiment described above, the problem may be restrained, and the faster recording may be achieved.

The CPU 91 may, when the recording mode is the high-quality mode, in other words, when the aimed velocity Vt is the first velocity Vt1, conduct S8 with reference to the first deceleration distance Lb1, but when the recording mode is the regular-quality mode, in other words, the aimed velocity Vt is the second velocity Vt2 being higher than the first velocity Vt1, the CPU 91 may conduct S8 with reference to the second deceleration distance Lb2 being longer than the first deceleration distance Lb2. In this arrangement, with use of the different deceleration distance Lb depending on to the aimed velocity Vt, the determination in S8 may be more effectively used in the recording process.

The CPU 91 may determine that at least a part of the deceleration range Rb in the n-th scanning action, e.g., the forward scanning action in the example of FIG. 6, coincides with the discharging range R (S8: YES) when the planned stop position, which may be derived at least from the end Rx of the discharging range R in the scanning direction of the n-th scanning action, e.g., the forward scanning direction D1 in the example of FIG. 7, and the deceleration distance Lb, exceeds the stop-limit position. In this arrangement, the determination in S8 may be more effectively used in the recording process.

The CPU 91 may derive the planned stop position from the end Rx of the discharging range R, the deceleration distance Lb, and the distance Ln being the distance in the scanning direction between the end 10*x* of the head 10 on the leading side in the scanning direction, e.g., the leftward end in the forward scanning direction D1 or the rightward end in the backward scanning direction D2, and one of the nozzle arrays among the nozzle arrays Nc, Nm, Ny, Nk that may discharge the inks in the n-th scanning action located at the end on the leading side in the direction reversed from the planned scanning direction in the n-th scanning action, e.g., the rightward end in the backward scanning direction D2 or the leftward end in the forward scanning direction D1. In this arrangement, with consideration of the nozzle arrays to be used for recording the image, the determination in S8 may be more effectively used in the recording process.

The CPU 91 may, when the deceleration range Rb does not coincide with the discharging range R in the n-th scanning action (S8: NO), conduct the n-th scanning action, e.g., the forward scanning action in the example of FIG. 6, as has been planned initially. In this arrangement, time related to S9 may be omitted, and faster recording of the image may be achieved.

Second Embodiment

Next, with reference to FIGS. 8A-8B and 9, the printer according to a second embodiment of the present disclosure will be described. The printer in the second embodiment is substantially similar to the printer in the first embodiment except the configuration described below.

In the second embodiment, as shown in FIG. 9, the distance X1 between the first stop-limit position and the one end 1*x* of the sheet 1 in the scanning direction is shorter than a distance X2 between the second stop-limit position and the other end 1*y* of the sheet 1 in the scanning direction.

Figure 8A:
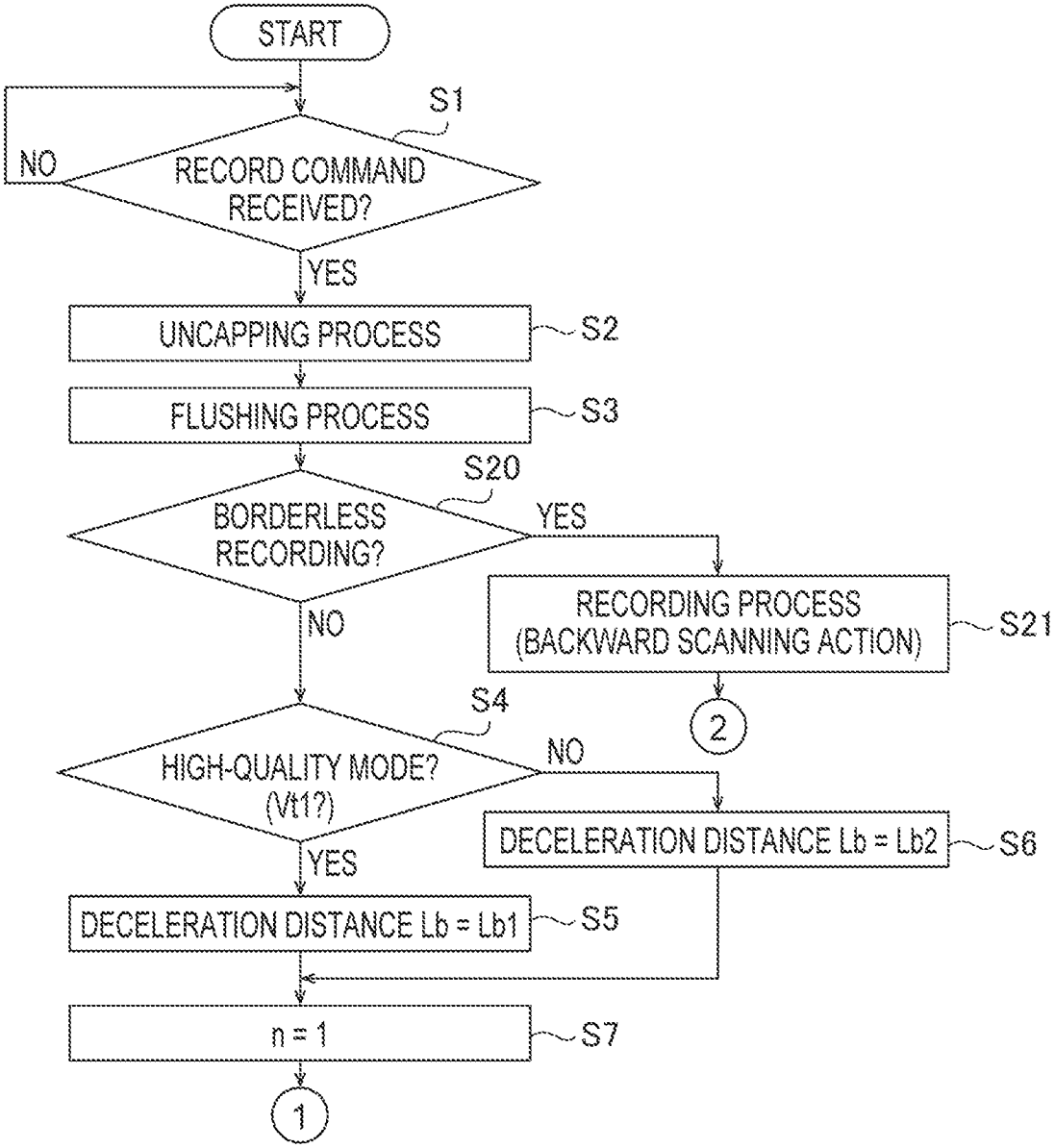
FIGS. 8A-8B are a flowchart to illustrate a flow of steps in a program to be executed by the CPU in the printer according to a second embodiment of the present disclosure.
Figure 8B:
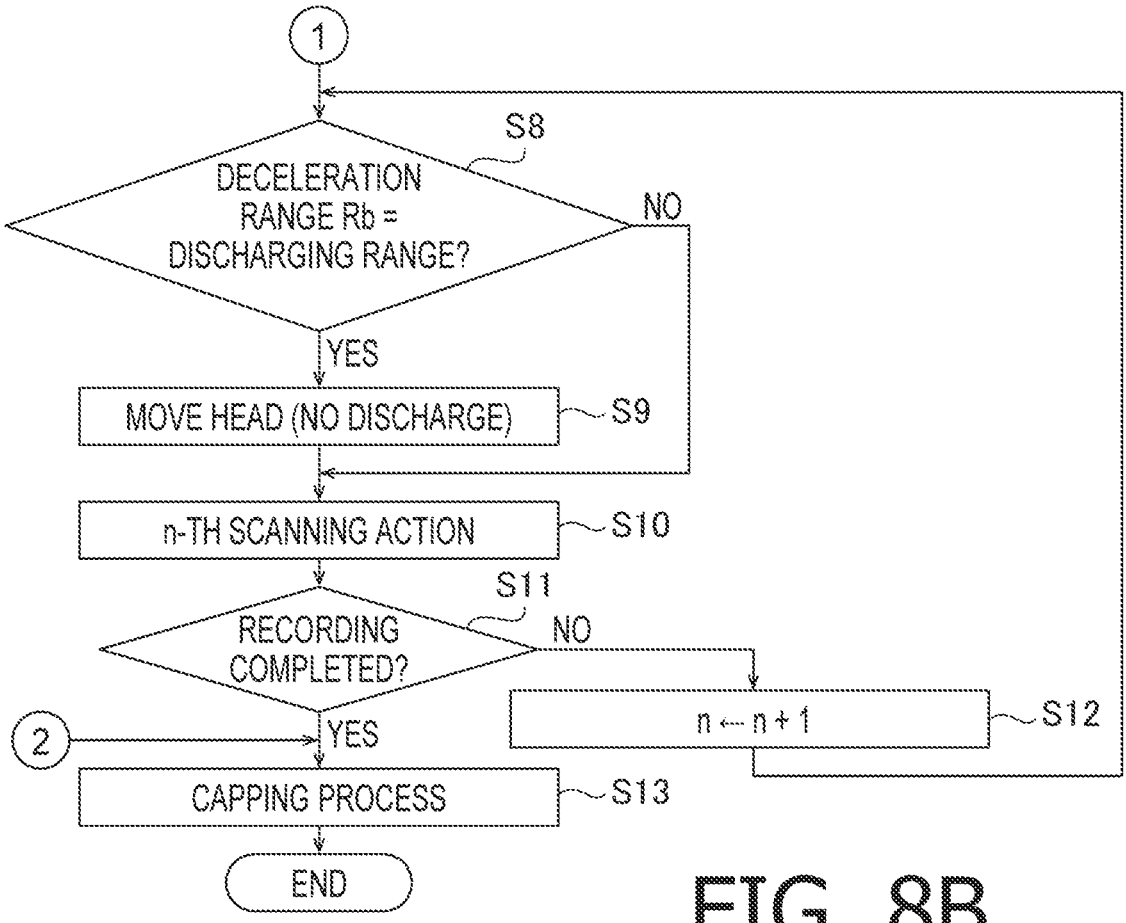

Moreover, in the second embodiment, as shown in FIG. 8A, after S3 and before S4, the CPU 91 determines whether borderless recording is to be conducted in S20. Borderless recording refers to recording, in which the inks may be discharged through the nozzles N at areas including edges of the sheet 1 in the scanning direction. On the other hand, bordered recording refers to recording, in which the inks may not be discharged through the nozzles N at the areas including the edges of the sheet 1 in the scanning direction. In borderless recording, no margin is reserved on the edges of the sheet 1, but in bordered recording, margins are reserved on the edges of the sheet 1.

If borderless recording is not to be conducted (S20: NO), in other words, if bordered recording is to be conducted, the CPU 91 proceeds to S4.

If borderless recording is to be conducted (S20: YES), the CPU 91 may not proceed to S4 but proceed to S21 to conduct a recording process, in which each scanning action is the backward scanning action, i.e., the scanning action in which the head 10 is moved in one way from the one end 1*x* toward the other end 1*y*. After S21, the CPU 91 proceeds to S13.

According to the second embodiment, additionally to the benefits achievable by the first embodiment, benefit as described below may be achieved.

That is, when borderless recording is to be conducted (S20: YES), the CPU 91 may conduct the scanning actions in the direction from the side, at which the shorter one of the distances X1, X2 is located, toward the other side, at which the longer one of the distances X1, X2 is located. In other words, the acceleration range Ra is arranged on the side, at which the shorter one of the distances X1, X2 is located, and the deceleration range Rb is arranged on the side, at which the longer one of the distances X1, X2 is located. In this arrangement, large-or-small relationship between the acceleration range Ra and the deceleration range Rb and large-or-small relationship between the distance X1 and the distance X2 correspond; therefore, the image may not be formed while the head 10 is accelerating or decelerating but may be formed while the head 10 moves at the constant velocity. Therefore, when borderless recording is conducted, the imaging quality may be restrained from being lowered.

Third Embodiment

Figure 10A:
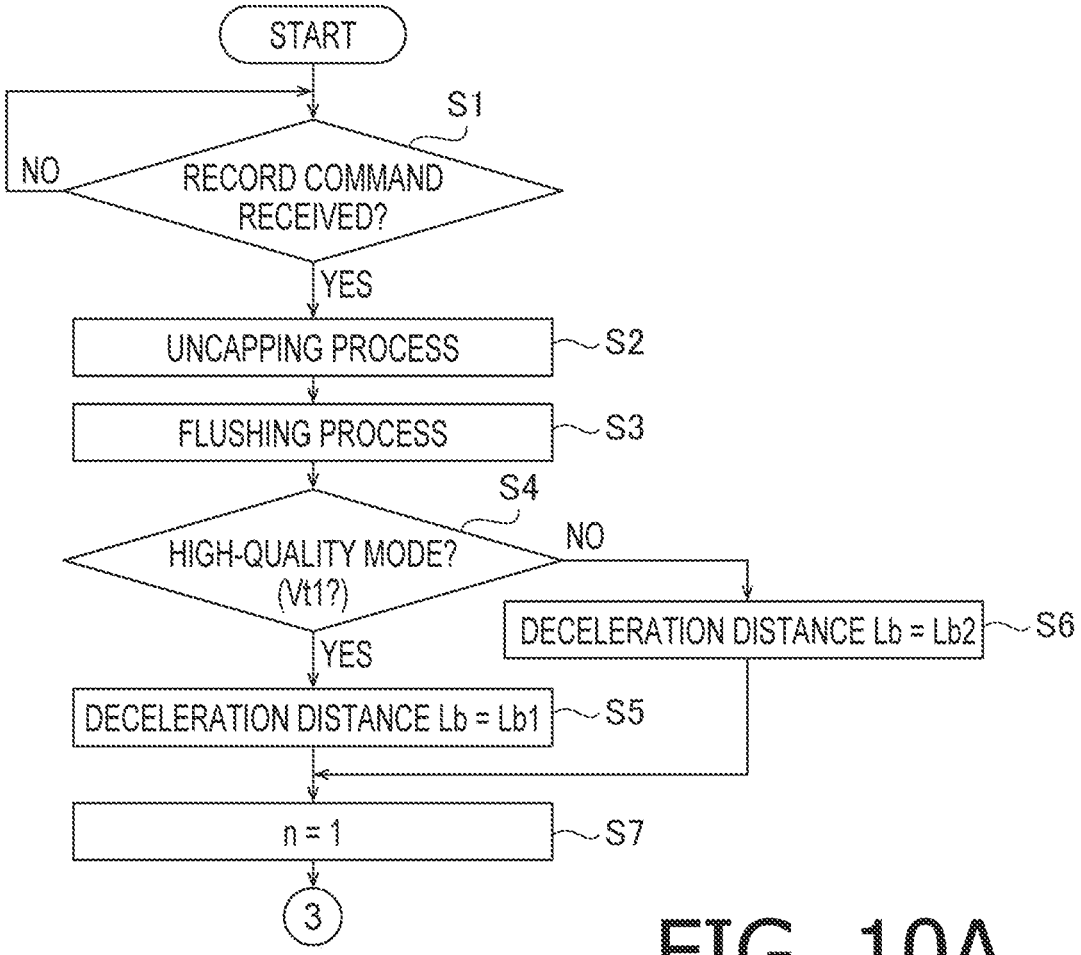
FIGS. 10A-10B are a flowchart to illustrate a flow of steps in a program to be executed by the CPU in the printer according to a third embodiment of the present disclosure.
Figure 10B:
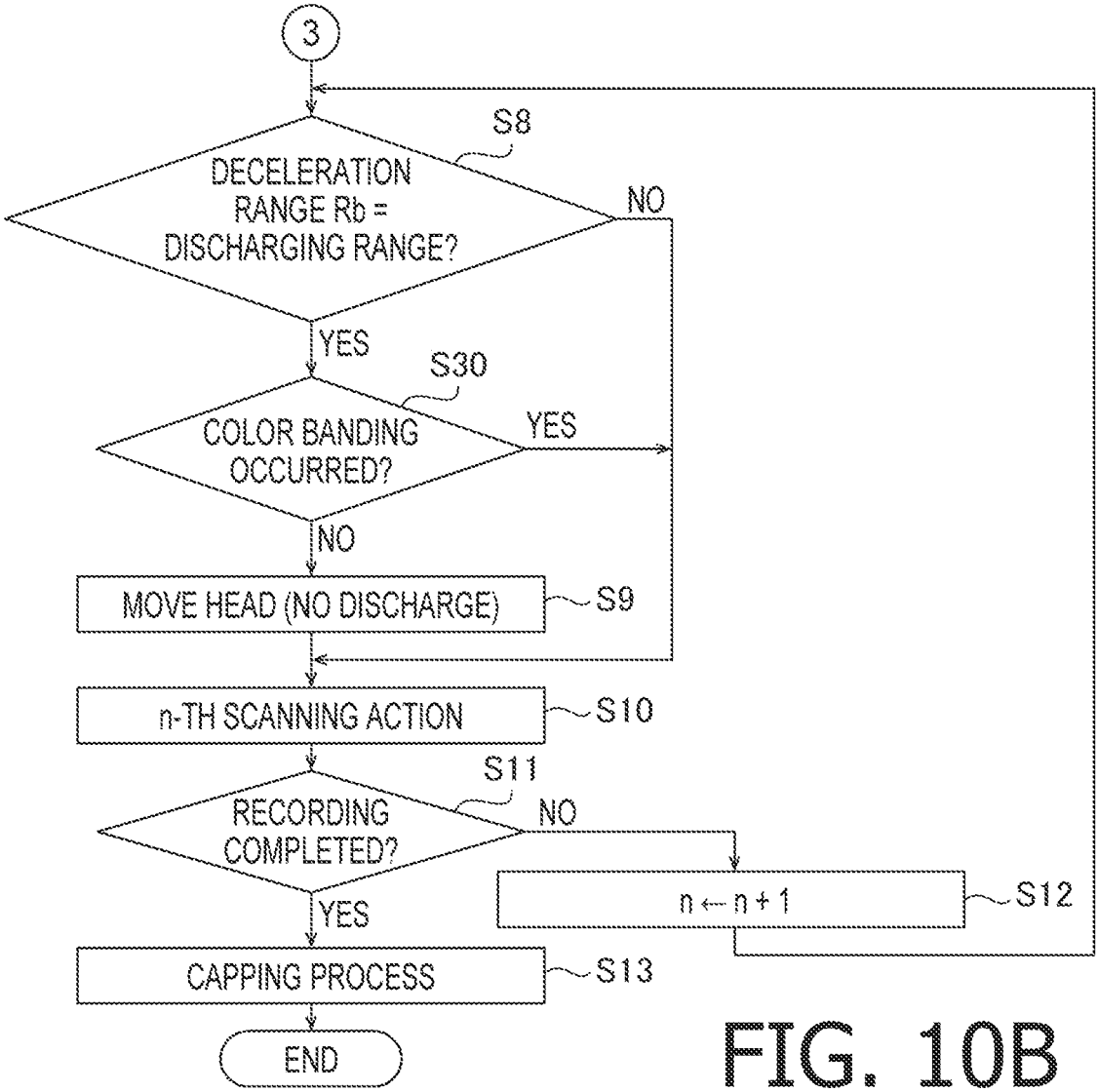

Next, with reference to FIGS. 10A-10B, the printer according to a third embodiment of the present disclosure will be described. The printer in the third embodiment is substantially similar to the printer in the first embodiment except the configuration described below.

The CPU 91 may, in S8, if at least a part of the deceleration range Rb coincides with the discharging range R (S8: YES), proceed to S30. In S30, the CPU 91 determines whether color banding may occur if a scanning action in the scanning direction reversed from the scanning direction of the initially planned scanning action is conducted, prior to S9. Color banding is a difference in colors caused by a difference in orders of overlaying inks in the scanning actions in the different scanning directions D1, D2. In particular, in S30, the CPU 91 determines whether an image formed in the (n−1)th scanning action prior to the n-th scanning action and an image to be formed in the scanning action in the direction reversed from the scanning direction of the initially planned n-th scanning action may cause color banding, based on the evaluation table stored in the ROM 92. The evaluation table may be prepared for restraining the difference in colors that may be caused by the order of overlaying the inks between the different scanning directions D1, D2, and in which sets of pixel values (RGB scale values between 0 and 255) and weight values are associated. In other words, in S30, the CPU 91 determines whether a quality of the image to be formed in the (n−1)th scanning action, i.e., the scanning action prior to the n-th scanning action, and in the scanning action (S10) in the direction reversed from the scanning direction of the initially planned n-th scanning action may be lower than or equal to a predetermined level.

If the CPU 91 determines that color banding may occur (S30: YES), in other words, if the CPU 91 determines that the quality of the image to be formed in the (n-1)th scanning action and in the scanning action (S10) in the direction reversed from the scanning direction of the initially planned n-th scanning action is lower than or equal to the predetermined level, the CPU 91 proceeds to S10, without conducting S9, and conduct the initially planned scanning action, which is the initially planned forward or backward scanning action.

If the CPU 91 determines that color banding may not occur (S30: NO), in other words, if the CPU 91 determines that the quality of the image to be formed in the (n−1)th scanning action and in the scanning action (S10) in the direction reversed from the scanning direction of the initially planned n-th scanning action is not lower than or equal to the predetermined level, the CPU 91 proceeds to S9 and to S10, in which the CPU 91 may not conduct the scanning action as it was planned initially but conducts the scanning action in the direction reversed from the direction having been planned initially. In other words, if the forward scanning action was planned initially, the CPU 91 may conduct the backward scanning action, or if the backward scanning action was planned initially, the CPU 91 may conduct the forward scanning action.

According to the third embodiment, additionally to the benefits achievable by the first embodiment, benefit as described below may be achieved.

That is, even when at least a part of the deceleration range Rb coincides with the discharging range R (S8: YES), the CPU 91 may conduct the initially planned scanning action, i.e., the initially planned forward or backward scanning action, if a lowering extent of the imaging quality due to the difference in the scanning directions D1, D2 is greater than a lowering extent of the imaging quality due to acceleration or deceleration of the head 10 while the image is being formed (S30: YES). Therefore, the imaging quality may be restrained from being lowered more preferably.

Fourth Embodiment

Figure 11A:
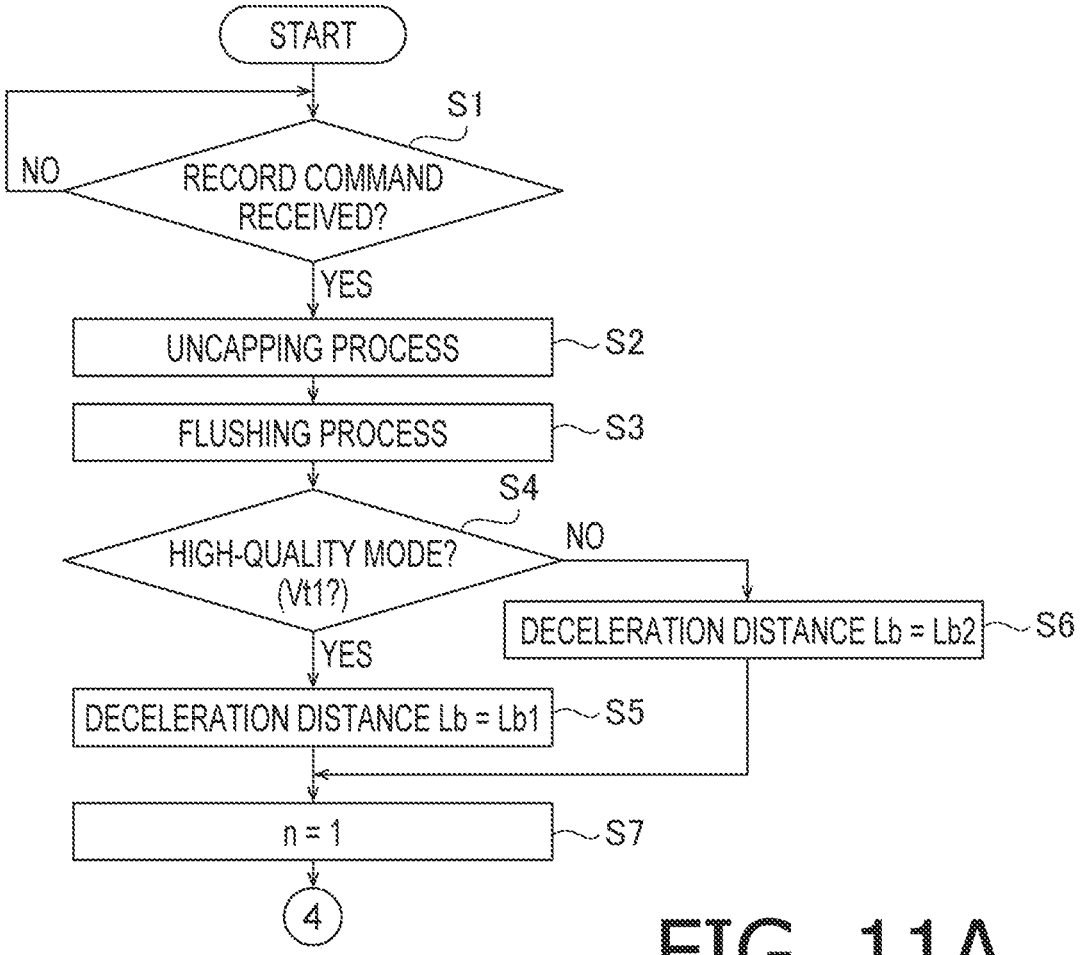
FIGS. 11A-11B are a flowchart to illustrate a flow of steps in a program to be executed by the CPU in the printer according to a fourth embodiment of the present disclosure.
Figure 11B:
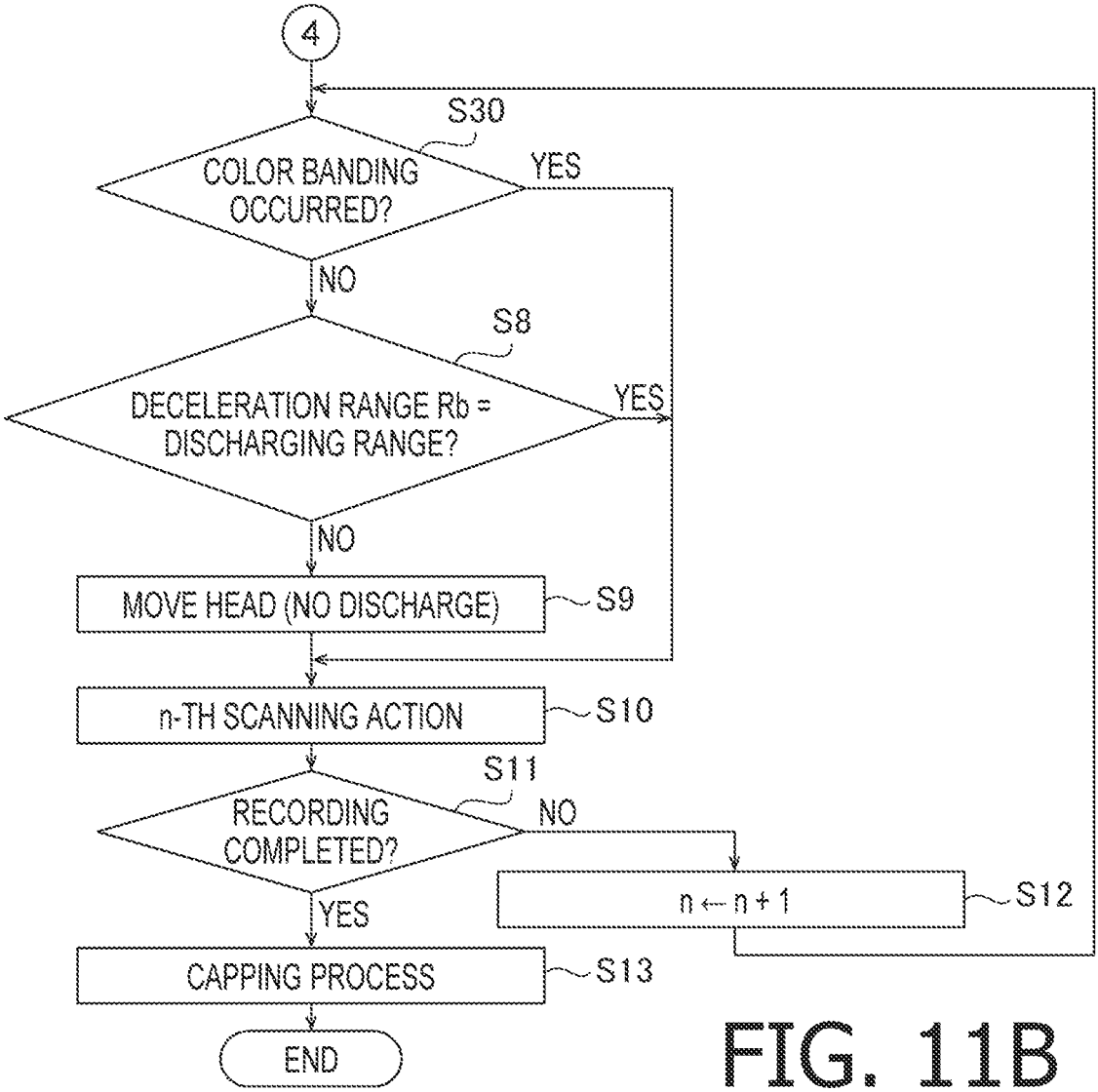

Next, with reference to FIGS. 11A-11B, the printer according to a fourth embodiment of the present disclosure will be described. The printer in the fourth embodiment is substantially similar to the printer in the third embodiment (see FIGS. 10A-10B) except the configuration described below.

In the third embodiment (see FIGS. 10A-10B), if at least a part of the deceleration range Rb coincides with the discharging range R (S8: YES), in S30 prior to S9, the CPU 91 determines whether color banding may occur (S30: YES). In contrast, in the fourth embodiment (see FIGS. 11A-11B), the CPU 91 may determine whether color banding may occur (S30) after S7 and prior to S8.

If the CPU 91 determines that color banding may occur (S30: YES), in other words, if the CPU 91 determines that the quality of the image to be formed in the (n−1)th scanning action and in the scanning action (S10) in the direction reversed from the scanning direction of the initially planned n-th scanning action is lower than or equal to the predetermined level, the CPU 91 proceeds to S10, without conducting S8 or S9, and conduct the initially planned scanning action, which is the initially planned forward or backward scanning action.

If the CPU 91 determines that color banding may not occur (S30: NO), in other words, if the CPU 91 determines that the quality of the image to be formed in the (n−1)th scanning action and in the scanning action (S10) in the direction reversed from the scanning direction of the initially planned n-th scanning action is not lower than or equal to the predetermined level, the CPU 91 proceeds to S8 and determines whether at least a part of the deceleration range Rb coincides with the discharging range R.

According to the fourth embodiment, additionally to the benefits achievable by the first embodiment, benefit as described below may be achieved.

That is, if a lowering extent of the imaging quality due to the difference in the scanning directions D1, D2 is greater than a lowering extent of the imaging quality due to acceleration or deceleration of the head 10 while the image is being formed (S30: YES), the CPU 91 may, without conducting S8, conduct the initially planned scanning action, i.e., the initially planned forward or backward scanning action. Therefore, the imaging quality may be restrained from being lowered more preferably in a less complicated process.

Fifth Embodiment

Figure 12A:
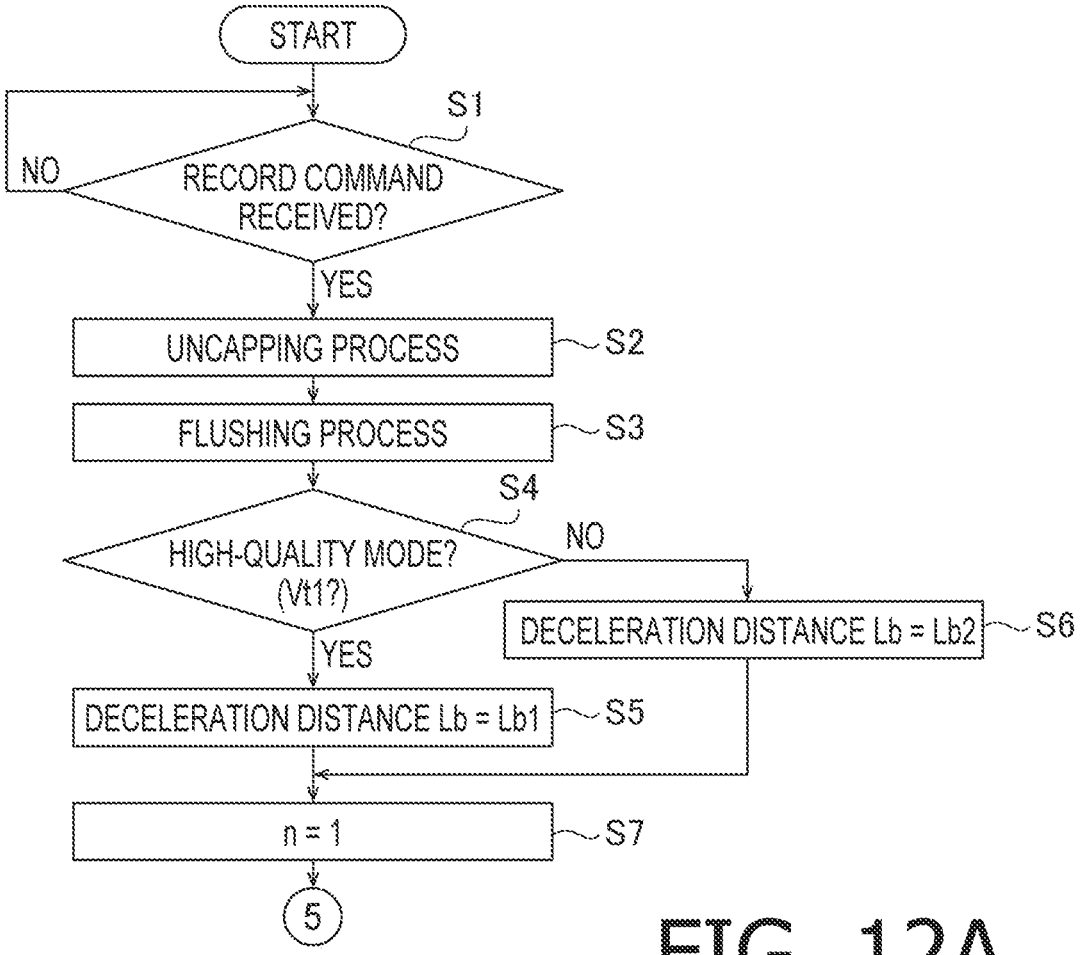
FIGS. 12A-12B are a flowchart to illustrate a flow of steps in a program to be executed by the CPU in the printer according to a fifth embodiment of the present disclosure.
Figure 12B:
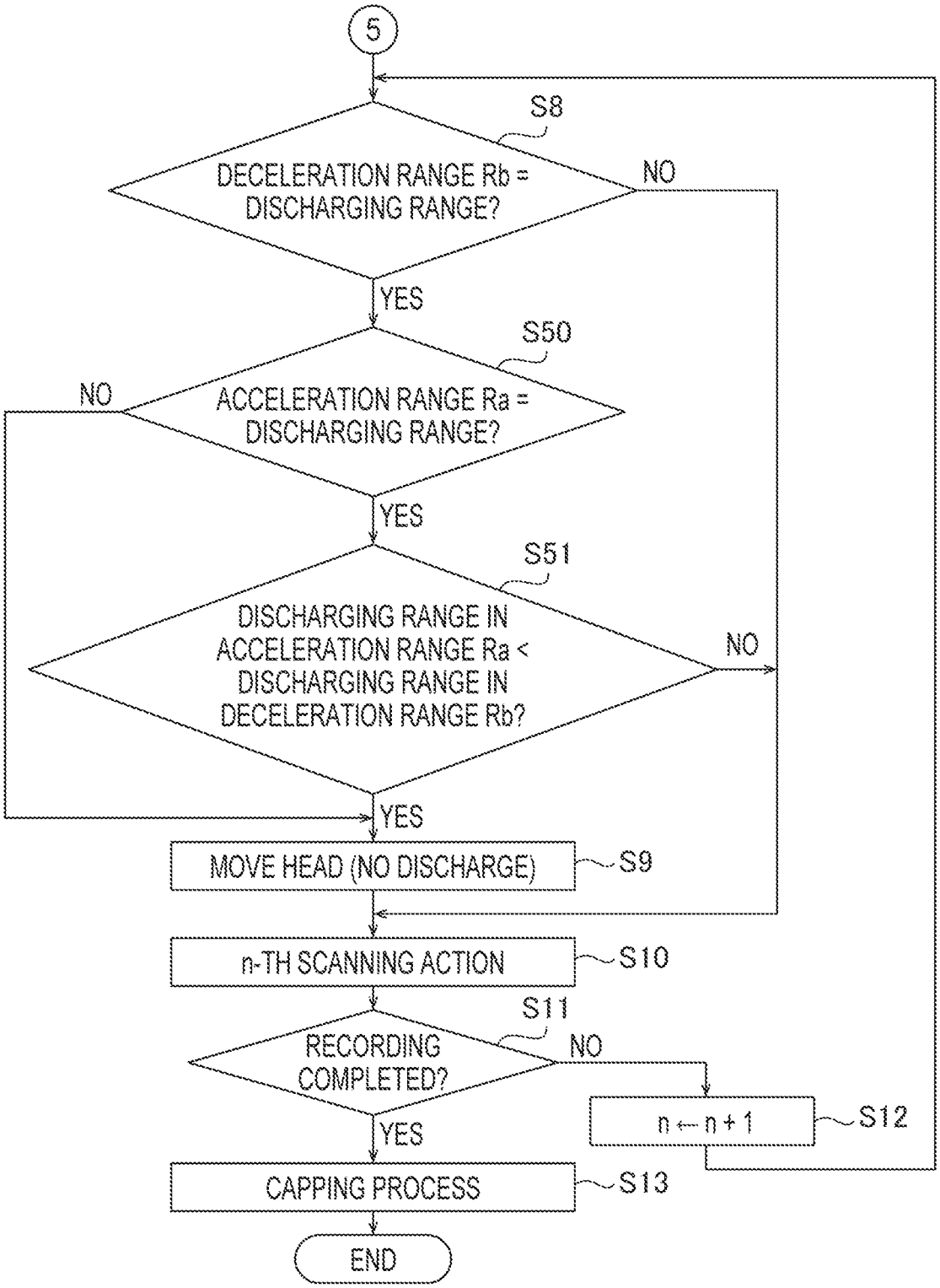

Next, with reference to FIGS. 12A-12B, the printer according to a fifth embodiment of the present disclosure will be described. The printer in the fifth embodiment is substantially similar to the printer in the first embodiment except the configuration described below.

In the fifth embodiment, if at least a part of the deceleration range Rb coincides with the discharging range R (S8: YES), prior to S9, in S50, the CPU 91 determines whether at least a part of the acceleration range Ra in the scanning action in the direction reversed from the initially planned scanning action (if the forward scanning action was planned initially, the backward scanning action, or if the backward scanning action was planned initially, the forward scanning action) coincides with the discharging range R, based on the partial image data, which is a part of the image data contained in the record command corresponding to the n-th scanning action.

If the acceleration range Ra in the scanning direction in the reversed direction does not coincide with the discharging range R (S50: NO), the CPU 91 proceeds to S9 and to S10, in which the CPU 91 may not conduct the scanning action as it was planned initially but conducts the scanning action in the direction reversed from the initially planned direction. In other words, if the forward scanning action was planned initially, the CPU 91 may conduct the backward scanning action, or if the backward scanning action was planned initially, the CPU 91 may conduct the forward scanning action.

If at least a part of the acceleration range Ra in the scanning direction in the reversed direction coincides with the discharging range R (S50: YES), in S51, the CPU 91 determines whether a part of the discharging range R coincident with the acceleration range Ra in the scanning action in the direction reversed from the initially planned scanning action, i.e., a part of the discharging range R overlapping the acceleration range Ra, is smaller than a part of the discharging range R coincident with the deceleration range Rb in the initially planned n-th scanning action, i.e., a part of the discharging range R overlapping the deceleration range Rb.

If the part of the discharging range R coincident with the acceleration range Ra in the scanning action in the reversed direction is not smaller than the part of the discharging range R coincident with the deceleration range Rb in the initially planned n-th scanning action (S51: NO), the CPU 91 proceeds to S10, in which the CPU 91 conducts the scanning action as it was planned initially. In other words, if the forward scanning action was planned initially, the CPU 91 may conduct the forward scanning action, or if the backward scanning action was planned initially, the CPU 91 may conduct the backward scanning action.

If the part of the discharging range R coincident with the acceleration range Ra in the scanning action in the reversed direction is smaller than the part of the discharging range R coincident with the deceleration range Rb in the initially planned n-th scanning action (S51: YES), the CPU 91 proceeds to S9 and to S10, in which the CPU 91 may not conduct the scanning action as it was planned initially but conducts the scanning action in the direction reversed from the direction having been planned initially. In other words, if the forward scanning action was planned initially, the CPU 91 may conduct the backward scanning action, or if the backward scanning action was planned initially, the CPU 91 may conduct the forward scanning action.

According to the fifth embodiment, additionally to the benefits achievable by the first embodiment, benefit as described below may be achieved.

That is, when at least a part of the deceleration range Rb coincides with the discharging range R (S8: YES), the CPU 91 may determine whether the acceleration range Ra in the scanning action in the reversed direction coincides with the discharging range R (S50). Thereafter, the scanning action in either one of the directions, in which an area of the image to be formed while the head 10 is accelerating or decelerating is smaller, may be conducted. In particular, if the part of the discharging range R coincident with the acceleration range Ra in the scanning action in the reversed direction is smaller than a part of the discharging range R coincident with the deceleration range Rb in the initially planned n-th scanning action (S51: YES), the scanning action in the reversed direction, in which the area of the image to be formed while the head 10 is accelerating or decelerating is smaller, may be conducted (S9, S10). On the other hand, if the part of the discharging range R coincident with the acceleration range Ra in the scanning action in the reversed direction is not smaller than the part of the discharging range R coincident with the deceleration range Rb in the initially planned n-th scanning action (S51: NO), the CPU 91 may conduct the initially planned scanning action, in which the area of the image to be formed while the head 10 is accelerating or decelerating is smaller (S10). Therefore, the imaging quality may be restrained from being lowered more preferably.

MODIFIED EXAMPLES

Although examples of carrying out the invention have been described, those skilled in the art will appreciate that there are numerous variations and permutations of the liquid discharging apparatus, the method for controlling the liquid discharging apparatus, and the computer-readable storage medium storing computer-readable instructions for discharging the liquid that fall within the spirit and the scope of the invention as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiments may merely be regarded as examples of the claimed subject matters.

For example, the options for the recording mode may not necessarily be limited to the high-quality mode and the regular-quality mode but may include, for example, a regular-paper mode and a glossy paper mode.

For another example, the controller may not necessarily determine in S8 whether at least a part of the deceleration range Rb coincides with the discharging range R based on the deceleration distance which corresponds to the aimed velocity but may determine in S8 based on a constant deceleration distance regardless of the aimed velocity.

For another example, the planned stop position may not necessarily be derived in consideration of the nozzle array to be used for recording the image, i.e., the distance Ln in FIG. 7, or the distance α, i.e., the value set in consideration of accuracy for stopping the head 10, as long as the planned stop position is derived at least from the end of the discharging range in the forward scanning direction and the deceleration distance.

For another example, the controller may not necessarily determine that at least a part of the deceleration range coincides with the discharging range if the planned stop position exceeds the stop-limit position, but the controller may determine that at least a part of the deceleration range coincides with the discharging range based on a different criterion which is not necessarily limited.

For another example, the head may not necessarily have the nozzles that may discharge different types of liquid, i.e., inks in different colors, but may have nozzles that may discharge a same type of liquid, e.g., ink in a same color.

For another example, the liquid to be discharged through the nozzles may not limited to the ink but may be liquid other than ink such as, for example, a processing solution that may coagulate or precipitate the components in the ink.

For another example, a material of the sheet may not necessarily be limited paper but may be, for example, fabric or resin.

For another example, the present disclosure may not necessarily be applicable to a printer as described above but may be applicable to a facsimile machine, a copier, and a multifunction peripheral machine. Moreover, the present disclosure may be applied to a liquid discharging apparatus usable in a purpose other than image recording, such as, for example, a liquid discharging apparatus to discharge conductive liquid to form conductive patterns on a substrate.

The programs related to the present disclosure may be distributed in a form of removable storage medium such as a flexible disk and/or an immobilized storage medium such as a hard disk, or through communication lines.

What is claimed is:

1. A liquid discharging apparatus, comprising:

a head having a plurality of nozzles;

a scanning assembly configured to move the head in a scanning direction, the scanning direction including a forward scanning direction and a backward scanning direction opposite to the forward scanning direction;

a conveyer configured to covey a recording medium with respect to the head in a conveying direction, the conveying direction intersecting with the scanning direction; and a controller configured to:

for recording an image on the recording medium, conduct actions to control the head to discharge liquid through the plurality of nozzles at the recording medium based on image data, the actions including:

a conveying action, in which the controller controls the conveyer to convey the recording medium by a predetermined amount in the conveying direction; and a scanning action, in which the controller controls the scanning assembly to move the head in the scanning direction and controls the head to discharge the liquid through the plurality of nozzles while the head is moved by the scanning assembly, the scanning action including a forward scanning action, in which the controller controls the head to discharge the liquid through the plurality of nozzles while moving the head in the forward scanning direction, and a backward scanning action, in which the controller controls the head to discharge the liquid through the plurality of nozzles while moving the head in the backward scanning direction, in each of the forward scanning action and the backward scanning action, a deceleration distance for the head being longer than an acceleration distance, wherein the controller is further configured to:

determine, prior to conducting the forward scanning action, whether at least a part of a deceleration range corresponding to the deceleration distance in the forward scanning action coincides with a discharging range, in which the liquid is to be discharged through the plurality of nozzles, in the forward scanning action, and in a case where the controller determines that at least a part of the deceleration range coincides with the discharging range in the forward scanning action, conduct the backward scanning action, without conducting the forward scanning action, based on partial image data being a part of the image data corresponding to the forward scanning action.

2. The liquid discharging apparatus according to claim 1, further comprising a storage storing the deceleration distance, the deceleration distance including:

a first deceleration distance to be referred to when an aimed velocity for the head in the forward scanning action is a first velocity; and a second deceleration distance to be referred to when the aimed velocity for the head in the forward scanning action is a second velocity being higher than the first velocity, the second deceleration distance being longer than the first deceleration distance, wherein, for determining whether at least a part of the deceleration range coincides with the discharging range in the forward scanning action, the controller is configured to:

in a case where the aimed velocity of the head in the forward scanning action is the first velocity, refer to the first deceleration distance stored in the storage; and in a case where the aimed velocity of the head in the forward scanning action is the second velocity, refer to the second deceleration distance stored in the storage.

3. The liquid discharging apparatus according to claim 1, wherein the controller is configured to determine that at least a part of the deceleration range coincides with the discharging range in the forward scanning action if a planned stop position for the head exceeds a stop-limit position, the planned stop position being derived at least from an end of the discharging range in the forward scanning direction and the deceleration distance.

4. The liquid discharging apparatus according to claim 3, wherein the plurality of nozzles have a plurality of nozzle arrays aligning along the scanning direction, and wherein, for determining whether at least a part of the deceleration range coincides with the discharging range in the forward scanning action, the controller is configured to derive the planned stop position from:

the end of the discharging range in the forward scanning direction;

the deceleration distance; and a distance in the scanning direction between an end of the head on a leading side in the forward scanning direction and one of the plurality of nozzle arrays that are to discharge the liquid in the forward scanning action located at an end on a leading side in the backward scanning direction.

5. The liquid discharging apparatus according to claim 3, wherein the stop-limit position includes:

a first stop-limit position located on a first side of the recording medium in the scanning direction, a distance in the scanning direction between the first stop-limit position and an edge of the recording medium on the first side in the scanning direction being shorter than a distance between the first stop-limit position and an edge of the recording medium on a second side in the scanning direction; and a second stop-limit position located on the second side of the recording medium in the scanning direction, a distance in the scanning direction between the second stop-limit position and the edge of the recording medium on the second side in the scanning direction being shorter than a distance between the second stop-limit position and the edge of the recording medium on the first side in the scanning direction, wherein the distance in the scanning direction between the first stop-limit position and the edge of the recording medium on the first side in the scanning direction is shorter than the distance in the scanning direction between the second stop-limit position and the edge of the recording medium on the second side in the scanning direction, and wherein the controller is configured to:

determine whether borderless recording, in which the head is controlled to discharge the liquid through the plurality of nozzles at areas including the edges of the recording medium on the first side and the second side in the scanning direction, is to be conducted, in a case where the controller determines that the borderless recording is not to be conducted, determine, prior to conducting the forward scanning action, whether at least a part of the deceleration range coincides with the discharging range in the forward scanning action, and in a case where the controller determines that the borderless recording is to be conducted, conduct one of the forward scanning action and the backward scanning action, in which the head is configured to be moved from the first side toward the second side in the scanning direction, without determining whether at least a part of the deceleration range coincides with the discharging range in the forward scanning action.

6. The liquid discharging apparatus according to claim 1, wherein, in the case where the controller determines that at least a part of the deceleration range in the forward scanning action coincides with the discharging range, the controller is configured to determine whether quality of an image to be formed in the scanning action conducted prior to the forward scanning action and in the backward scanning action based on the partial image data is lower than or equal to a predetermined level, wherein, in a case where the controller determines that the quality of the image is lower than or equal to the predetermined level, the controller is configured to conduct the forward scanning action, and wherein, in a case where the controller determines that the quality of the image is not lower than or equal to the predetermined level, the controller is configured to conduct the backward scanning action based on the partial image data without conducting the forward scanning action.

7. The liquid discharging apparatus according to claim 1, wherein, prior to conducting the forward scanning action and determining whether at least a part of the deceleration range coincides with the discharging range in the forward scanning action, the controller is configured to determine whether quality of an image to be formed in the scanning action conducted prior to the forward scanning action and in the backward scanning action to be conducted when the forward scanning action is not conducted is lower than or equal to a predetermined level, wherein, in a case where the controller determines that the quality of the image is lower than or equal to the predetermined level, the controller is configured to conduct the forward scanning action, and wherein, in a case where the controller determines that the quality of the image is not lower than or equal to the predetermined level, the controller is configured to determine whether at least a part of the deceleration range coincides with the discharging range in the forward scanning action.

8. The liquid discharging apparatus according to claim 1, wherein, in the case where the controller determines that at least a part of the deceleration range coincides with the discharging range in the forward scanning action, the controller is configured to determine whether at least a part of an acceleration range corresponding to the acceleration distance in the backward scanning action based on the partial image data coincides with a discharging range, in which the liquid is to be discharged through the plurality of nozzles, in the backward scanning action, wherein, in a case where the controller determines that at least a part of the acceleration range coincides with the discharging range in the backward scanning action, the controller is configured to determine whether a part of the discharging range in the backward scanning action coincident with the acceleration range in the backward scanning action is smaller than a part of the discharging range in the forward scanning action coincident with the deceleration range in the forward scanning action, and wherein, in a case where the controller determines that the part of the discharging range in the backward scanning action coincident with the acceleration range in the backward scanning action is not smaller than the part of the discharging range in the forward scanning action coincident with the deceleration range in the forward scanning action, the controller is configured to conduct the forward scanning action, and wherein, in a case where the controller determines that the part of the discharging range in the backward scanning action coincident with the acceleration range in the backward scanning action is smaller than the part of the discharging range in the forward scanning action coincident with the deceleration range in the forward scanning action, the controller is configured to conduct the backward scanning action based on the partial image data without conducting the forward scanning action.

9. The liquid discharging apparatus according to claim 1, wherein, in a case where the controller determines that the deceleration range in the forward scanning action does not coincide with the discharging range in the forward scanning action, the controller is configured to conduct the forward scanning action.

10. A method for controlling a liquid discharging apparatus, the liquid discharging apparatus comprising a head having a plurality of nozzles, a scanning assembly configured to move the head in a scanning direction, the scanning direction including a forward scanning direction and a backward scanning direction opposite to the forward scanning direction, a conveyer configured to covey a recording medium with respect to the head in a conveying direction, the conveying direction intersecting with the scanning direction, the method comprising:

for recording an image on the recording medium, conducting actions to control the head to discharge liquid through the plurality of nozzles at the recording medium based on image data, the actions including:

a conveying action, in which the conveyer is controlled to convey the recording medium by a predetermined amount in the conveying direction; and a scanning action, in which the scanning assembly is controlled to move the head in the scanning direction and the head is controlled to discharge the liquid through the plurality of nozzles while being moved by the scanning assembly, the scanning action including a forward scanning action, in which the head is controlled to discharge the liquid through the plurality of nozzles while being moved in the forward scanning direction, and a backward scanning action, in which the head is controlled to discharge the liquid through the plurality of nozzles while being moved in the backward scanning direction, in each of the forward scanning action and the backward scanning action, a deceleration distance for the head being longer than an acceleration distance, determining, prior to conducting the forward scanning action, whether at least a part of a deceleration range corresponding to the deceleration distance in the forward scanning action coincides with a discharging range, in which the liquid is to be discharged through the plurality of nozzles, in the forward scanning action, and in a case where at least a part of the deceleration range is determined to coincide with the discharging range in the forward scanning action, conducting the backward scanning action, without conducting the forward scanning action, based on partial image data being a part of the image data corresponding to the forward scanning action.

11. A non-transitory computer readable storage medium storing computer readable instructions that are executable by a computer configured to control a liquid discharging apparatus, the liquid discharging apparatus comprising a head having a plurality of nozzles, a scanning assembly configured to move the head in a scanning direction, the scanning direction including a forward scanning direction and a backward scanning direction opposite to the forward scanning direction, a conveyer configured to covey a recording medium with respect to the head in a conveying direction, the conveying direction intersecting with the scanning direction, the computer readable instructions, when executed by the computer, causing the computer to:

for recording an image on the recording medium, conduct actions to control the head to discharge liquid through the plurality of nozzles at the recording medium based on image data, the actions including:

a conveying action, in which the computer controls the conveyer to convey the recording medium by a predetermined amount in the conveying direction; and a scanning action, in which the computer controls the scanning assembly to move the head in the scanning direction and controls the head to discharge the liquid through the plurality of nozzles while the head is moved by the scanning assembly, the scanning action including a forward scanning action, in which the computer controls the head to discharge the liquid through the plurality of nozzles while moving the head in the forward scanning direction, and a backward scanning action, in which the computer controls the head to discharge the liquid through the plurality of nozzles while moving the head in the backward scanning direction, in each of the forward scanning action and the backward scanning action, a deceleration distance for the head being longer than an acceleration distance, determine, prior to conducting the forward scanning action, whether at least a part of a deceleration range corresponding to the deceleration distance in the forward scanning action coincides with a discharging range, in which the liquid is to be discharged through the plurality of nozzles, in the forward scanning action, and in a case where the computer determines that at least a part of the deceleration range coincides with the discharging range in the forward scanning action, conduct the backward scanning action, without conducting the forward scanning action, based on partial image data being a part of the image data corresponding to the forward scanning action.

* * * * *